US006828881B2

(12) United States Patent
Mizutani et al.

(10) Patent No.: US 6,828,881 B2
(45) Date of Patent: Dec. 7, 2004

(54) STACKED DIELECTRIC FILTER

(75) Inventors: Yasuhiko Mizutani, Saku (JP); Takami Hirai, Aichi (JP); Kazuhiro Kadota, Okazaki (JP); Takanobu Saka, Tajimi (JP); Hironobu Kimura, Saku (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 10/186,280

(22) Filed: Jun. 27, 2002

(65) Prior Publication Data

US 2003/0020568 A1 Jan. 30, 2003

(30) Foreign Application Priority Data

Jul. 2, 2001 (JP) ..... 2001-201419
Mar. 4, 2002 (JP) ..... 2002-057107

(51) Int. Cl.[7] ..... H01P 1/20

(52) U.S. Cl. ..... 333/204; 333/25; 333/26; 333/185

(58) Field of Search ..... 333/204, 25, 26, 333/185

(56) References Cited

U.S. PATENT DOCUMENTS 5,497,137 A 3/1996 Fujiki
5,705,960 A * 1/1998 Izumiyama ..... 333/26
5,793,265 A * 8/1998 Spielman ..... 333/132
5,949,299 A * 9/1999 Harada ..... 333/25
2001/0010507 A1 8/2001 Hiroshima et al.
2002/0171508 A1 * 11/2002 Harada et al. ..... 333/133

FOREIGN PATENT DOCUMENTS

| | | |
|---|---|---|
| GB | 2351615 A | 1/2001 |
| GB | 2370921 A | 7/2002 |
| JP | 2773617 | 4/1998 |
| JP | 2840814 | 10/1998 |
| JP | 11-317603 | 11/1999 |
| JP | 2000-22404 | 1/2000 |
| JP | 2000-353904 | 12/2000 |

* cited by examiner

*Primary Examiner*—Robert Pascal
*Assistant Examiner*—Kimberly Glenn
(74) *Attorney, Agent, or Firm*—Burr & Brown

(57) ABSTRACT

A stacked dielectric filter includes a filter section which has first and second input side resonant electrodes and first and second output side resonant electrodes of two ¼ wavelength resonators, a converting section which has a plurality of strip lines, and a connecting section which connects the filter section and the converting section, wherein the filter section, the converting section, and the connecting section are formed in a dielectric substrate. The filter section is formed at an upper portion in the stacking direction of dielectric layers. The converting section is formed at a lower portion in the stacking direction. The connecting section is formed between the filter section and the converting section.

39 Claims, 30 Drawing Sheets

STACKED DIELECTRIC FILTER

This application claims the benefit of Japanese Application 2001-201419, filed Jul. 2, 2001, and Japanese Application 2002-057107, filed Mar. 4, 2002, the entireties of which are incorporated herein by reference.

BACKGROUND OF THE INVENTION

1. Field of the Invention

The present invention relates to a stacked dielectric filter which constitutes a resonance circuit in a microwave band of several hundreds MHz to several GHz. In particular, the present invention relates to a stacked dielectric filter which makes it possible to effectively miniaturize communications equipment and electronics equipment.

2. Description of the Related Art

In recent years, there has been a strong demand to realize a small-sized and thin high frequency filter to be used for wireless communication equipment. Therefore, it is indispensable to use a stacked dielectric filter.

In general, as shown in FIG. 30, such a stacked dielectric filter, for example, a stacked dielectric filter 400 using a ¼ wavelength resonator has a plurality of resonant electrodes 402, 404, inner layer ground electrodes 406, 408, 410, 412, and a coupling-adjusting electrode 414. Each of the plurality of resonant electrodes 402, 404 has an end electrically connected to a ground electrode. Each of the inner layer ground electrodes 406, 408, 410, 412 has an end electrically connected to the ground electrode. The inner layer ground electrodes 406, 410 are stacked to sandwich a part of an open end of the resonant electrode 402 and a dielectric layer. The inner layer ground electrodes 408, 412 are stacked to sandwich a part of an open end of the resonant electrode 404 and the dielectric layer. The coupling-adjusting electrode 414 electromagnetically couples the respective resonant electrodes 402, 404.

However, in the stacked dielectric filter 400 as shown in FIG. 30, the ground electric potential is used as the reference electric potential for inputting/outputting a signal of an unbalanced form. Therefore, for example, in order to connect the stacked dielectric filter 400 to a high frequency amplifying circuit of the balanced input type, it is necessary to use a balun (balanced-unbalanced converter) additionally between them. Consequently, a certain limit arises in the miniaturization.

In the above example, the stacked dielectric filter using the ¼ wavelength resonator is described. Additionally, stacked dielectric filters of the balanced type using ½ wavelength resonators have been also suggested (see, for example, Japanese Laid-Open Patent Publication 11-317603, 2000-353904, and 2000-22404).

In each of the stacked dielectric filters of the balanced type, the resonator length is inevitably increased, because the stacked dielectric filter is composed of the ½ wavelength resonator. Therefore, such a stacked dielectric filter is disadvantageous to realize a small sized filter.

SUMMARY OF THE INVENTION

It is therefore an object of the present invention to provide a stacked dielectric filter of a small size which enables a balanced input/output for connection to a high frequency amplifying circuit or the like.

Another object of the present invention is to provide a stacked dielectric filter in which it is unnecessary to separately insert any circuit for connecting a DC power source to an IC when the IC is connected to an unbalanced-balanced converting section, while reducing the number of parts, suppressing the insertion loss, and miniaturizing the size of electronic devices including the IC.

Still another object of the present invention is to provide a stacked dielectric filter in which it is unnecessary to separately insert any circuit for matching the impedance between an unbalanced-balanced converting section and an IC when the IC is connected to the unbalanced-balanced converting section, and it is possible to reduce the number of parts, while suppressing the insertion loss, and miniaturizing the size of the electronic devices including the IC.

Still another object of the present invention is to provide a stacked dielectric filter which enables an increased degree of flexibility of design.

Still another object of the present invention is to provide a stacked dielectric filter in which it is possible to reduce the electrode area in a filter section, and it is possible to suppress the stray coupling in an unbalanced-balanced converting section.

The present invention provides a stacked dielectric filter comprising a filter section having a plurality of resonators for filtering an unbalanced signal, and at least one unbalanced-balanced converting section having strip lines. The filter section and the unbalanced-balanced converting sections are in a dielectric substrate including a plurality of stacked dielectric layers.

Accordingly, the filter section can be composed of the ¼ wavelength resonator by which it is advantageous to realize the miniaturization. It is possible to realize compact or small sized devices as compared with stacked dielectric filters of the balanced type composed of ½ wavelength resonators.

Further, it is unnecessary to set the characteristic impedance between the filter section and the unbalanced-balanced converting section to have a specified value (for example, 50Ω). The characteristic impedance can be arbitrarily determined. Therefore, it is possible to enhance the degree of flexibility of design. Further, the filter section can be easily formed, and it is possible to widen the line width of the strip line of the balun section, because the characteristic impedance can be determined to be low. Therefore, it is possible to reduce the loss in the unbalanced-balanced converting section.

As described above, the present invention provides the stacked dielectric filter of the small size which enables the balanced input/output for connection to the high frequency amplifying circuit or the like.

In the stacked dielectric filter, the plurality of dielectric layers of different materials may be laminated or stacked to provide the dielectric substrate. Preferably, a dielectric constant of the dielectric layer corresponding to the filter section is higher than a dielectric constant of the dielectric layer corresponding tothe unbalanced-balanced converting section.

Accordingly, it is possible to reduce the electrode area in the filter section, and it is possible to suppress the stray coupling in the unbalanced-balanced converting section.

The stacked dielectric filter may be exemplarily constructed as follows. For example, the filter section is formed at an upper portion or a lower portion in a stacking direction of the plurality of dielectric layers of the dielectric substrate, and the unbalanced-balanced converting section is formed at a portion other than the upper portion and the lower portion. In this arrangement, an inner layer ground electrode for isolating the filter section from the unbalanced-balanced converting section can be easily formed between the filter section and the unbalanced-balanced converting section. Thus, it is possible to improve the characteristics.

Alternatively, the filter section may be formed at a left portion or a right portion in a stacking direction of the plurality of dielectric layers of the dielectric substrate, and the unbalanced-balanced converting section may be formed at a portion other than the left portion and the right portion.

Further, ground electrodes may be formed on both principal surfaces of the dielectric substrate, and planes on which resonant electrodes of the plurality of resonators are formed and planes on which the ground electrodes are formed may be parallel to one another. Planes on which input/output terminals of the filter section are formed and planes on which the strip lines of the unbalanced-balanced converting section are formed may be perpendicular to one another.

Alternatively, ground electrodes may be formed on both principal surfaces of the dielectric substrate, and planes on which resonant electrodes of the plurality of resonators are formed and planes on which the ground electrodes are formed may be perpendicular to one another. In this arrangement, planes on which input/output terminals of the filter section are formed and planes on which the strip lines of the unbalanced-balanced converting section are formed may be parallel to one another. The input/output terminals of the filter section and the strip lines can be arranged away from each other. Therefore, it is possible to eliminate any unnecessary interference between the input/output terminals of the filter section and the strip lines of the unbalanced-balanced converting section. Thus, it is possible to improve the characteristics.

Further, the unbalanced-balanced converting section may be connected via a connecting section to an input side and/or an output side of the filter section. In this arrangement, the stacked dielectric filter may further comprise an inner layer ground electrode which is provided in the dielectric substrate and which is connected to a ground electrode, wherein the connecting section is formed separately from the unbalanced-balanced converting section with the inner layer ground electrode interposed therebetween, and the connecting section is electrically connected to an unbalanced input/output section of the unbalanced-balanced converting section. It is preferable that the inner layer ground electrode is formed for at least isolating the filter section from the unbalanced-balanced converting section.

It is preferable that the connecting section has a connecting electrode which is connected to the filter section via a capacitor. If the filter section is directly connected to the unbalanced-balanced converting section, then unnecessary matching issues are caused between the filter section and the unbalanced-balanced converting section in the attenuation region of the bandpass characteristics, and an unnecessary peak is formed in the attenuation region. Accordingly, when the filter section is connected to the unbalanced-balanced converting section via the capacitor as in the present invention, then the phase of the unbalanced-balanced converting section is shifted by the capacitor, and it is possible to suppress the unnecessary matching with respect to the filter section. If the connecting electrode is arranged on the side of the unbalanced-balanced converting section, the connecting electrode may be coupled to the unbalanced-balanced converting section, and the bandpass characteristics may be deteriorated. Therefore, it is preferable that the connecting electrode is arranged on the side of the filter section.

On the other hand, the unbalanced-balanced converting section may comprise a first strip line which is formed on a first principal surface of the dielectric layer and which has a first end constituting an unbalanced input/output section; a second strip line which is formed on a first principal surface of the dielectric layer, which has a first end connected to one balanced input/output terminal, and which is connected to a ground electrode at an arbitrary position on the line; and a third strip line which is formed on the first principal surface of the dielectric layer, which has a first end connected to the other balanced input/output terminal, and which is connected to the ground electrode at an arbitrary position on the line.

In this arrangement, the stacked dielectric filter may further comprise an inner layer ground electrode which is provided in the dielectric substrate and which is connected to the ground electrode, wherein second ends of the second and third strip lines are connected to the inner layer ground electrode through via-holes.

Alternatively, when a DC electrode, which is connected to a DC power source, is formed on a surface of the dielectric substrate, the unbalanced-balanced converting section may comprise a first strip line which is formed on a first principal surface of the dielectric layer and which has a first end constituting an unbalanced input/output section; a second strip line which is formed on a first principal surface of the dielectric layer, which has a first end connected to one balanced input/output terminal, and which is connected to the DC electrode at an arbitrary position on the line; and a third strip line which is formed on the first principal surface of the dielectric layer, which has a first end connected to the other balanced input/output terminal, and which is connected to the DC electrode at an arbitrary position on the line.

In this arrangement, the stacked dielectric filter may further comprise an inner layer ground electrode which is provided in the dielectric substrate and which is connected to a ground electrode, wherein the second and third strip lines are connected to the DC electrode at respective arbitrary positions on the second and third strip lines through viaholes respectively beyond the inner layer ground electrode. Alternatively, the stacked dielectric filter may further comprise an inner layer DC electrode which is provided in the dielectric substrate and which is connected to the DC electrode, wherein the second and third strip lines are connected to the inner layer DC electrode at respective arbitrary positions on the second and third strip lines through the via-holes respectively.

Explanation will now be made for an exemplary form of use of the stacked dielectric filter. When the stacked dielectric filter is used, an IC is connected to the stacked dielectric filter in many cases. In such cases, the DC voltage is separately supplied to the IC in some types.

Usually, it is necessary to provide a dedicated circuit for supplying the DC voltage between the stacked dielectric filter and the IC. However, in the present invention, the balanced signal, in which the received signal component is superimposed on the DC voltage, is outputted. Therefore, it is unnecessary to connect the dedicated circuit. Accordingly, it is possible to miniaturize the circuit system including the stacked dielectric filter and the IC.

It is preferable that the second and third strip lines are arranged in linear symmetry about a center of a line by which a line segment for connecting the plurality of balanced input/output terminals is equally divided into two, and respective physical lengths of the second and third strip lines are substantially identical with each other. Accordingly, it is possible to obtain the good balance for the input/output characteristics of the respective balanced input/output terminals.

In the present invention, a width of a first portion of the first strip line corresponding to the second strip line, a length of the first portion, a width of a second portion of the first strip line corresponding to the third strip line, a length of the second portion, a width of the second strip line, an electrically effective length of the second strip line, a width of the third strip line, an electrically effective length of the third strip line, and a dielectric constant of the dielectric layer disposed between the first strip line and the second and third strip lines are appropriately changed. By doing so, it is possible to easily establish an output impedance, level balance, and phase balance of the unbalanced-balanced converting section.

Usually, the output impedance of the unbalanced-balanced converting section is twice the input impedance of the unbalanced-balanced converting section. For example, when the input impedance of the unbalanced-balanced converting section is 50Ω, the output impedance is 100Ω. However, for example, when the impedance, which is required to effect the matching to the IC to be connected to the unbalanced-balanced converting section, is 50Ω, then the impedance matching is not satisfied, and an additional circuit is required to effect the impedance matching.

However, in the present invention, even when the input impedance of the unbalanced-balanced converting section is 50Ω, the output impedance of the unbalanced-balanced converting section can be easily matched to the input impedance of the IC by appropriately setting the various parameters described above.

Alternatively, the input impedance of the unbalanced-balanced converting section may have a value other than 50Ω. For example, when the input impedance is 25Ω, the output impedance of the unbalanced-balanced converting section can be 50Ω. In the above example, it is possible to satisfy the impedance matching with respect to the IC without separately inserting any impedance-matching circuit, helping the size of the circuit system including the stacked dielectric filter and the IC to be reduced.

Alternatively, the unbalanced-balanced converting section may comprise a first strip line which is formed on a first principal surface of the dielectric layer and which has a first end constituting an unbalanced input/output section; a second strip line which is formed on a first principal surface of the dielectric layer, which has a first end connected to one balanced input/output terminal, and which is connected to a ground electrode at an arbitrary position on the line; a third strip line which is formed on a first principal surface of the dielectric layer and which has a first end connected to a second end of the first strip line; and a fourth strip line which is formed on a first principal surface of the dielectric layer, which has a first end connected to the other balanced input/output terminal, and which is connected to the ground electrode at an arbitrary position on the line.

In this arrangement, planes on which input/output terminals of the filter section are formed and respective planes on which the first to fourth strip lines of the unbalanced-balanced converting section are formed can be parallel to one another. Accordingly, the input/output terminals of the filter section and the strip lines are arranged away from each other. Therefore, it is possible to eliminate any unnecessary interference between the input/output terminals of the filter section and the strip lines of the unbalanced-balanced converting section. Thus, it is possible to improve the characteristics.

The stacked dielectric filter may further comprise an inner layer ground electrode connected to the ground electrode, the inner layer ground electrode being formed between the dielectric layer on which the second strip line is formed and the dielectric layer on which the third strip line is formed, wherein the second strip line is connected to the inner layer ground electrode at an arbitrary position on the second strip line. In this arrangement, one coupling line based on the first strip line and the second strip line is separated from the other coupling line based on the third strip line and the fourth strip line by the second inner layer ground electrode. Therefore, it is possible to suppress any interference between the coupling lines, and it is possible to obtain the good balance of the input/output characteristics of the unbalanced-balanced converting section.

When a DC electrode, which is connected to a DC power source, is formed on a surface of the dielectric substrate, the unbalanced-balanced converting section may comprise a first strip line which is formed on a first principal surface of the dielectric layer and which has a first end constituting an unbalanced input/output section; a second strip line which is formed on a first principal surface of the dielectric layer, which has a first end connected to one balanced input/output terminal, and which is connected to the DC electrode at an arbitrary position on the line; a third strip line which is formed on a first principal surface of the dielectric layer and which has a first end connected to a second end of the first strip line; and a fourth strip line which is formed on a first principal surface of the dielectric layer, which has a first end connected to the other balanced input/output terminal, and which is connected to the DC electrode at an arbitrary position on the line.

In this arrangement, the stacked dielectric filter may further comprise an inner layer ground electrode which is provided in the dielectric substrate and which is connected to a ground electrode, wherein the second and fourth strip lines are connected to the DC electrode at respective arbitrary positions on the second and fourth strip lines through via-holes respectively beyond the inner layer ground electrode. Alternatively, the stacked dielectric filter may further comprise an inner layer DC electrode which is provided in the dielectric substrate and which is connected to the DC electrode, wherein the second and fourth strip lines are connected to the inner layer DC electrode at respective arbitrary positions on the second and fourth strip lines through the via-holes respectively.

Further, in the present invention, a width of the first strip line, a length of the first strip line, a width of the second strip line, an electrically effective length of the second strip line, a width of the third strip line, a length of the third strip line, a width of the fourth strip line, an electrically effective length of the fourth strip line, and a dielectric constant or dielectric constants of one or more of the dielectric layers disposed in a region ranging from the first strip line to the fourth strip line are appropriately determined. Accordingly, it is possible to easily determine an output impedance, level balance, and phase balance of the unbalanced-balanced converting section.

In this arrangement, an input impedance of the unbalanced-balanced converting section may have a value other than 50Ω.

In the present invention, a coupling-adjusting electrode for adjusting a coupling degree for the plurality of resonators is formed at a position separated from the connecting section with the resonators interposed therebetween. In this arrangement, if the coupling-adjusting electrode is formed near the connecting section, any stray coupling may be generated between the coupling-adjusting electrode and the connecting section (or the connecting electrode when the connecting section has the connecting electrode connected to the filter section via the capacitor), and it is impossible to eliminate the unnecessary matching. For this reason, it is preferable that the coupling-adjusting electrode is formed at the position separated from the connecting section with the resonators interposed therebetween.

When the resonators are composed of a plurality of resonant electrodes arranged in a stacking direction, the coupling-adjusting electrode may be formed on a first principal surface of one dielectric layer of one or more of the dielectric layers arranged between the resonant electrodes.

In the present invention, the plurality of resonators of the filter section may have different resonance frequencies respectively, and an apparent reactance element may be equivalently connected to an output side of the unbalanced-balanced balanced converting section. Accordingly, when an IC is connected to the unbalanced-balanced converting section, the impedance matching between the unbalanced-balanced converting section and the IC can be realized without inserting any additional matching circuit. Thus, the size of the circuit system including the stacked dielectric filter and the IC can be compact.

As described above, the stacked dielectric filter according to the present invention provides the following effects.

(1) It is possible to effectively realize the miniaturization while realizing the balanced input/output taking the connection of the high frequency amplifying circuit or the like into consideration.

(2) When the IC is connected to the unbalanced-balanced converting section, it is unnecessary to separately insert the circuit for connecting the DC power source to the IC. It is possible to reduce the number of parts, suppress the insertion loss, and miniaturize the size of the electronic devices including the IC.

(3) When the IC is connected to the unbalanced-balanced converting section, it is unnecessary to insert the circuit for matching the impedance between the unbalanced-balanced converting section and IC. It is possible to reduce the number of parts, suppress the insertion loss, and miniaturize the size of the electronic devices including the IC.

(4) It is possible to increase the degree of flexibility of the design.

(5) It is possible to reduce the electrode area in the filter section, and it is possible to suppress the stray coupling in the unbalanced-balanced converting section.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Several illustrative embodiments of a dielectric filter of a stacked type according to the present invention will be explained below with reference to FIGS. 1 to 29. In the following embodiments, explanation will be made principally for a case in which an input side is of an unbalanced type and an output side is of a balanced type. The present invention is also applicable to a case reverse to the above, as well as to the case in which both the input side and output side are balanced.

Figure 1:
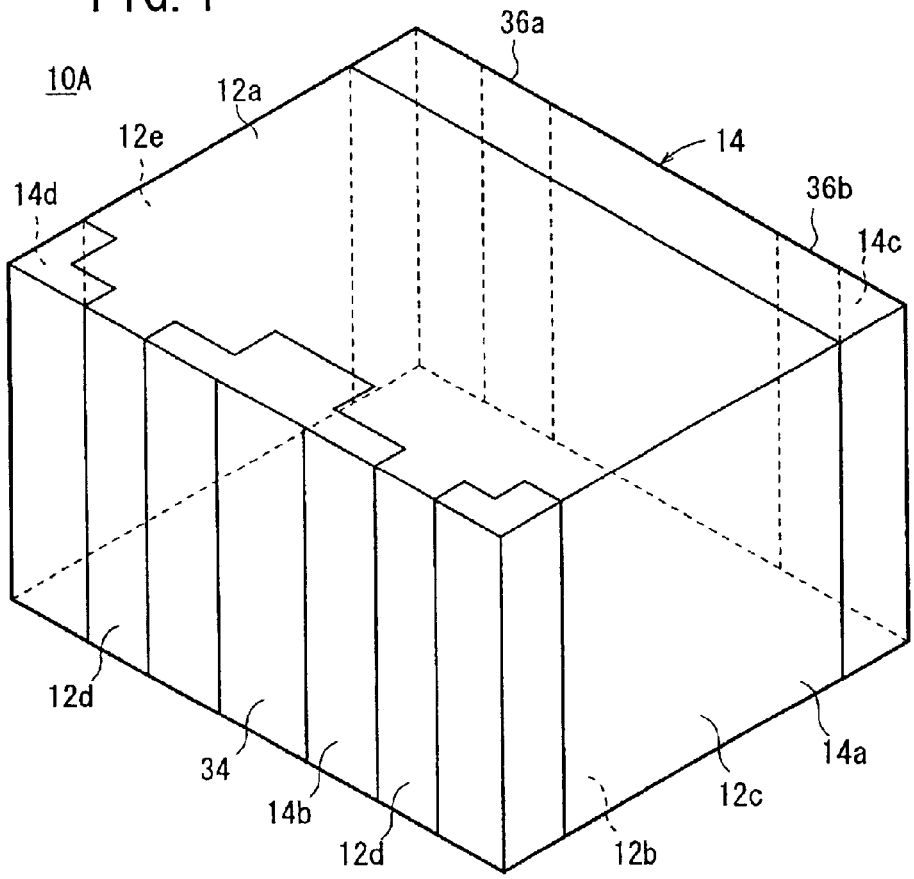
FIG. 1 shows a perspective view illustrating a stacked dielectric filter according to a first embodiment.

As shown in FIG. 1, a stacked dielectric filter 10A according to a first embodiment has a dielectric substrate 14. The dielectric substrate 14 comprises a plurality of dielectric layers (S1 to S10, see FIG. 2) which are stacked, sintered, and integrated into one unit. Ground electrodes 12*a*, 12*b* are formed on both principal surfaces (first principal surface of the first dielectric layer S1 and first principal surface of the tenth dielectric layer S10) of the dielectric substrate 14.

Figure 2:
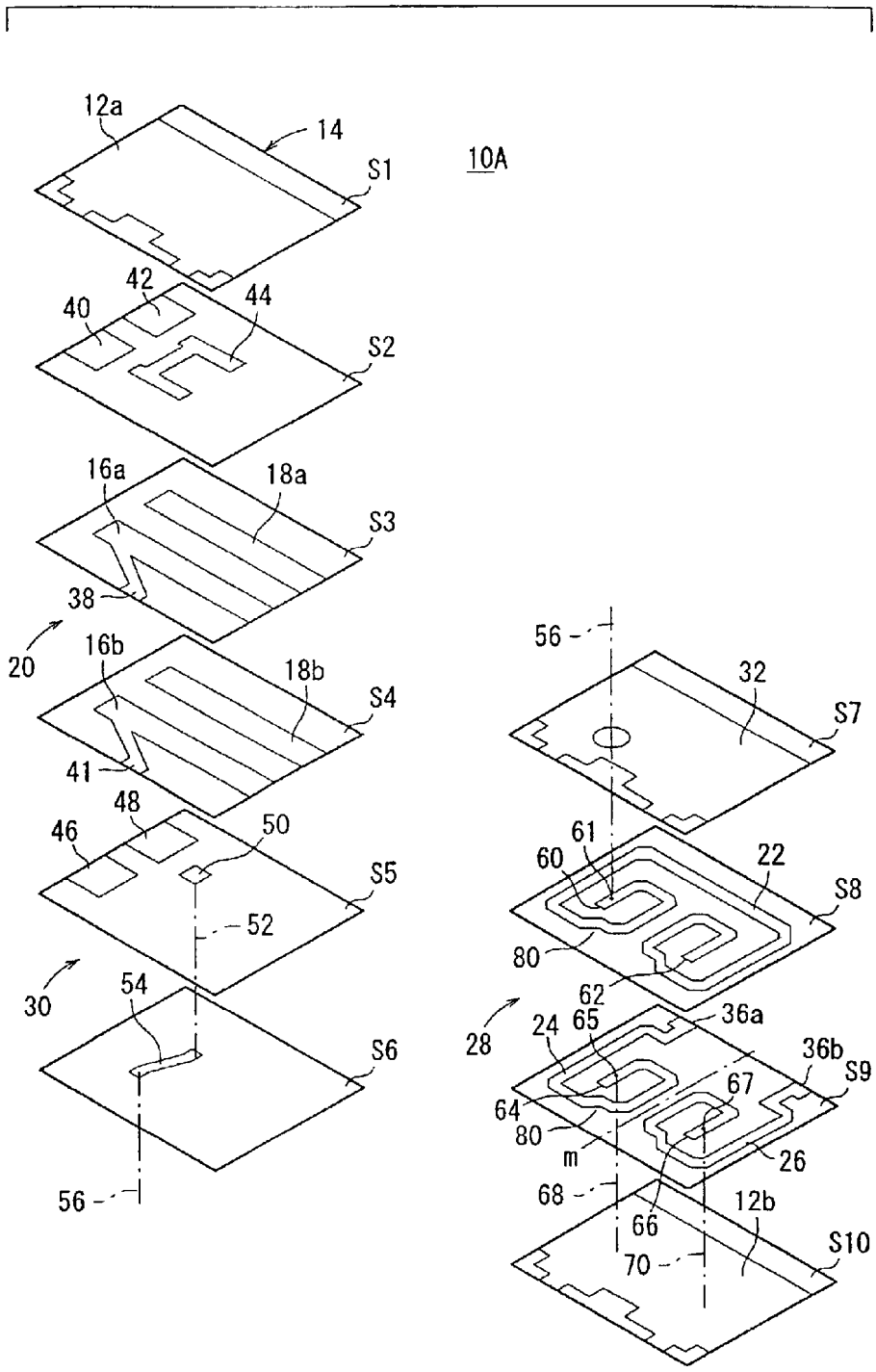
FIG. 2 shows an exploded perspective view illustrating the stacked dielectric filter according to the first embodiment.

As shown in FIG. 2, a filter section 20, an unbalanced-balanced converting section (converting section 28), and a connecting section 30 are provided in the dielectric substrate 14. The filter section 20 has first and second input side resonant electrodes 16*a*, 16*b* (¼ wavelength input side resonator) and first and second output side resonant electrodes 18*a*, 18*b* (¼ wavelength output side resonator). The converting section 28 has a plurality of strip lines 22, 24, 26. The connecting section 30 connects the filter section 20 and the converting section 28. In this embodiment, one input side resonator is constructed by the first and second input side resonant electrodes 16*a*, 16*b* which are aligned in the stacking direction, and one output side resonator is constructed by the first and second output side resonant electrodes 18*a*, 18*b* which are aligned in the stacking direction.

As shown in FIG. 2, the dielectric substrate 14 comprises the first dielectric layer S1 to the tenth dielectric layer S10 which are piled up in this order from the top. Each of the first to tenth dielectric layers S1 to S10 has one layer or a plurality of layers.

The filter section 20 and the converting section 28 are formed in regions which are separated vertically in the stacking direction of the dielectric layers S1 to S10 in the dielectric substrate 14 respectively. For example, as viewed in FIG. 2, the filter section 20 is formed at an upper portion in the stacking direction, the converting section 28 is formed at a lower portion in the stacking direction, and the connecting section 30 is formed between the filter section 20 and the converting section 28.

In other words, the filter section 20 is formed in the region ranging from the second dielectric layer S2 to the fifth dielectric layer S5, the converting section 28 is formed in the region including the eighth and ninth dielectric layers S8, S9, and the connecting section 30 is formed in the region including the fifth and sixth dielectric layers S5, S6. Further, an inner layer ground electrode 32, which is provided in order to isolate the filter section 20 from the converting section 28, is formed in the dielectric substrate 14.

The first and second input side resonant electrodes 16*a*, 16*b* and the first and second output side resonant electrodes 18*a*, 18*b* constitute the two ¼ resonators respectively. Therefore, for example, as shown in FIG. 1, the short circuit end of each of the resonant electrodes 16*a*, 16*b*, 18*a*, 18*b* is connected to a ground electrode 12*c* which is formed on a first side surface 14*a* of the dielectric substrate 14.

In the filter 10A, as shown in FIG. 1, an unbalanced input terminal 34 is formed at a central portion of a second side surface 14*b* of the outer circumferential surface of the dielectric substrate 14, and ground electrodes 12*d* are formed on both sides of the unbalanced input terminal 34. First and second balanced output terminals 36*a*, 36*b* are formed on a third side surface 14*c* which is disposed on the side opposite to the second side surface 14*b*. There are areas for insulating the unbalanced input terminal 34 and the balanced output terminals 36*a*, 36*b* from the ground electrodes (including the inner layer ground electrode).

As shown in FIG. 2, the first input side resonant electrode 16*a* and the first output side resonant electrode 18*a* are formed on the first principal surface of the third dielectric layer S3. A first lead electrode 38 is formed between a position in the vicinity of the open end of the first input side resonant electrode 16*a* and the unbalanced input terminal 34 (see FIG. 1).

The second input side resonant electrode 16*b* and the second output side resonant electrode 18*b* are formed on the first principal surface of the fourth dielectric layer S4. A second lead electrode 41 is formed between a position in the vicinity of the open end of the second input side resonant electrode 16*b* and the unbalanced input terminal 34.

First and second inner layer ground electrodes 40, 42 and a coupling-adjusting electrode 44 are formed on the first principal surface of the second dielectric layer S2. Both first ends of the inner layer ground electrodes 40, 42 are connected to the ground electrode 12*e*. The ground electrode 12*e* is formed on the fourth side surface 14*d* of the dielectric substrate 14 (see FIG. 1). The second dielectric layer S2 is interposed between the inner layer ground electrode 40 and the open end of the first input side resonant electrode 16*a* and between the inner layer ground electrode 42 and the open end of the first output side resonant electrode 18*a*. The coupling-adjusting electrode 44 is an electrode for adjusting the coupling degree for the input side resonator and the output side resonator.

Third and fourth inner layer ground electrodes 46, 48 and an output capacitor electrode 50 are formed on the first principal surface of the fifth dielectric layer S5. Both first ends of the third and fourth inner layer ground electrodes 46, 48 are connected to the ground electrode 12*e*. The fourth dielectric layer S4 is interposed between the inner layer ground electrode 46 and the open end of the second input side resonant electrode 16*b*, between the inner layer ground electrode 48 and the open end of the second output side resonant electrode 18*b*, and between the output capacitor electrode 50 and the second output side resonant electrode 18*b*. The output capacitor electrode 50 is electrically connected to a connecting electrode 54 through a via-hole 52 which is provided for the fifth dielectric layer S5.

The connecting electrode 54, which is provided in order to connect the output side of the filter section 20 and the input side of the converting section 28, is formed on the first principal surface of the sixth dielectric layer S6. The first end of the connecting electrode 54 is connected to the via-hole 52 described above. The fourth and fifth dielectric layers S4, S5 are interposed between the second end of the connecting electrode 54 and the second input side resonant electrode 16*b*. The second end of the connecting electrode 54 is connected to a via-hole 56 which is communicated with the converting section 28. The connecting section 30 is constructed by the output capacitor electrode 50, the via-hole 52, and the connecting electrode 54.

The inner layer ground electrode 32 is formed on the first principal surface of the seventh dielectric layer S7. There is an area for insulating the inner layer ground electrode 32 from the via-hole 56, i.e., the area on which no electrode film is formed.

The first strip line 22 of the converting section 28 is formed on the first principal surface of the eighth dielectric layer S8. The first strip line 22 is patterned in a spiral form from a start end 60 (first start end 60). The first strip line 22 is configured to be converged in a spiral form toward a terminal end 62 arranged at a position in linear symmetry to the first start end 60 (position in linear symmetry about a line m by which a line segment for connecting the first and second balanced output terminals 36*a*, 36*b* is equally divided into two). The second end of the connecting electrode 54 described above is electrically connected through the via-hole 56 at the first start end 60 or at a position in the vicinity of the first start end 60 of the first strip line 22. In the following description, the position of connection with respect to the via-hole 56 on the first strip line 22 is referred to as "first connection position 61".

The second and third strip lines 24, 26 in the converting section 28 are formed on the first principal surface of the ninth dielectric layer S9. The second strip line 24 is configured to be patterned in a spiral form from a start end (second start end 64) corresponding to the first start end 60 of the first strip line 22 described above toward the first balanced output terminal 36*a*. The third strip line 26 is configured to be patterned in a spiral form from a start end (third start end 66) corresponding to the terminal end 62 of the first strip line 22 described above toward the second balanced output terminal 36*b*.

It is preferable that the spiral shapes of the second and third strip lines 24, 26 are mutually in linear symmetry (linear symmetry about the line m). Physical lengths of the second and third strip lines 24, 26 are substantially identical with each other.

The second strip line 24 is electrically connected to the ground electrode 12*b* through the via-hole 68 at the second start end 64 or at a position in the vicinity of the second start end 64 (second connection portion 65). The third strip line 26 is electrically connected to the ground electrode 12*b* through the via-hole 70 at the third start end 66 or at a position in the vicinity of the third start end 66 (third connection portion 67).

In other words, in the filter 10A, the planes, on which the respective resonant electrodes 16*a*, 16*b*, 18*a*, 18*b* of the input side resonator and the output side resonator are formed, are parallel to the planes on which the ground electrodes 12*a*, 12*b* are formed. Further, in the filter 10A, the plane (second side surface 14*b*), on which the unbalanced input terminal 34 of the filter section 20 is formed, is perpendicular to the planes on which the respective strip lines 22, 24, 26 in the converting section 28 are formed.

Further, in the filter 10A, the first to tenth dielectric layers S1 to S10 of arbitrarily established different materials are used as the plurality of dielectric layers of the dielectric substrate 14, and the dielectric layers are stacked, sintered, and integrated into one unit.

It is preferable that dielectric layers having high dielectric constants (for example, $\in$=25) are used as the dielectric layers (first to sixth dielectric layers S1 to S6) of the portion for forming the capacitor in the filter section 20. The dielectric layers having low dielectric constants (for example, $\in$=7) are used as the dielectric layers (seventh to tenth dielectric layers S7 to S10) for the converting section 28.

As described above, in the filter 10A, the filter section 20 of the unbalanced input system and the converting section 28 having the first to third strip lines 22, 24, 26 are integrated into one unit in the dielectric substrate 14. Therefore, the filter 10A can be constructed with the ¼ wavelength resonator which is advantageous to realize the small size as the filter section 20. It is possible to miniaturize the filter as compared with a stacked dielectric filter of the balanced type of the ½ wavelength resonator.

When the components are integrated into one unit, it is unnecessary for the characteristic impedance between the filter section 20 and the converting section 28 to have a specified value (for example, 50Ω). It is possible to arbitrarily determine the characteristic impedance between the filter section 20 and the converting section 28. Therefore, it is possible to flexibly design filters. Further, the filter section 20 can be easily formed, and the line widths of the strip lines 22, 24, 26 in the converting section 28 can be widened, because the characteristic impedance between both can be low. Therefore, the loss in the converting section 28 can be also reduced.

It is preferable in the filter 10A, that the dielectric layer of the portion for forming the capacitor in the filter section 20 is made of material different from the material of the dielectric layer for the converting section 28. The dielectric constant of the dielectric layer of the portion for forming the capacitor in the filter section 20 should be higher than the dielectric constant of the dielectric layer for the converting section 28. Therefore, it is possible to reduce the electrode area in the filter section 20. Further, it is possible to suppress the stray coupling in the converting section 28.

The filter section 20 is formed at the upper portion in the stacking direction of the dielectric layers of the dielectric substrate 14, and the converting section 28 is formed at the lower portion in the stacking direction. Therefore, the inner layer ground electrode 32, which is provided in order to isolate the filter section 20 from the converting section 28, can be easily formed between the filter section 20 and the converting section 28. Thus, it is possible to improve the characteristics. The mounting area is also reduced by arranging the filter section 20 and the converting section 28 at the upper and lower portions of the dielectric substrate 14 respectively.

When the tap structure, in which the second output side resonant electrode 18*b* is directly connected to the converting section 28, is adopted, then the filter section 20 and the converting section 28 may cause unnecessary matching issues in an attenuation region of the bandpass characteristic, and an unnecessary peak may be formed in the attenuation region. However, in the filter 10A, the filter section 20 is connected to the converting section 28 via the capacitor by the output capacitor electrode 50 with respect to the second output side resonant electrode 18*b*. Therefore, it is possible to shift the phase of the converting section 28 with the capacitor, and it is possible to suppress the unnecessary matching issues with respect to the filter section 20. Further, the connecting electrode 54 is formed on the side of the filter section 20 (at the position close to the filter section 20 as compared with the inner layer ground electrode 32). Therefore, no unnecessary peak is generated in the bandpass characteristic.

The second and third strip lines 24, 26 are in linear symmetry about the line m by which the line segment for connecting the first and second balanced output terminals 36*a*, 36*b* is equally divided into two. Therefore, it is possible to obtain the good balance for the output characteristics of the respective balanced output terminals 36*a*, 36*b*.

In the filter 10A, a relief 80 in a spiral shape is formed in each of the first to third strip lines 22, 24, 26 in the converting section 28 so that the interference with the unbalanced input terminal 34 is suppressed. In the filter 10A, each of the first to third strip lines 22, 24, 26 is partially bent so that a certain distance is maintained from the unbalanced input terminal 34.

An exemplary experiment will now be described. In this exemplary experiment, the bandpass characteristic and the reflection characteristic were investigated for a Comparative Example and a Working Example.

Figure 30:
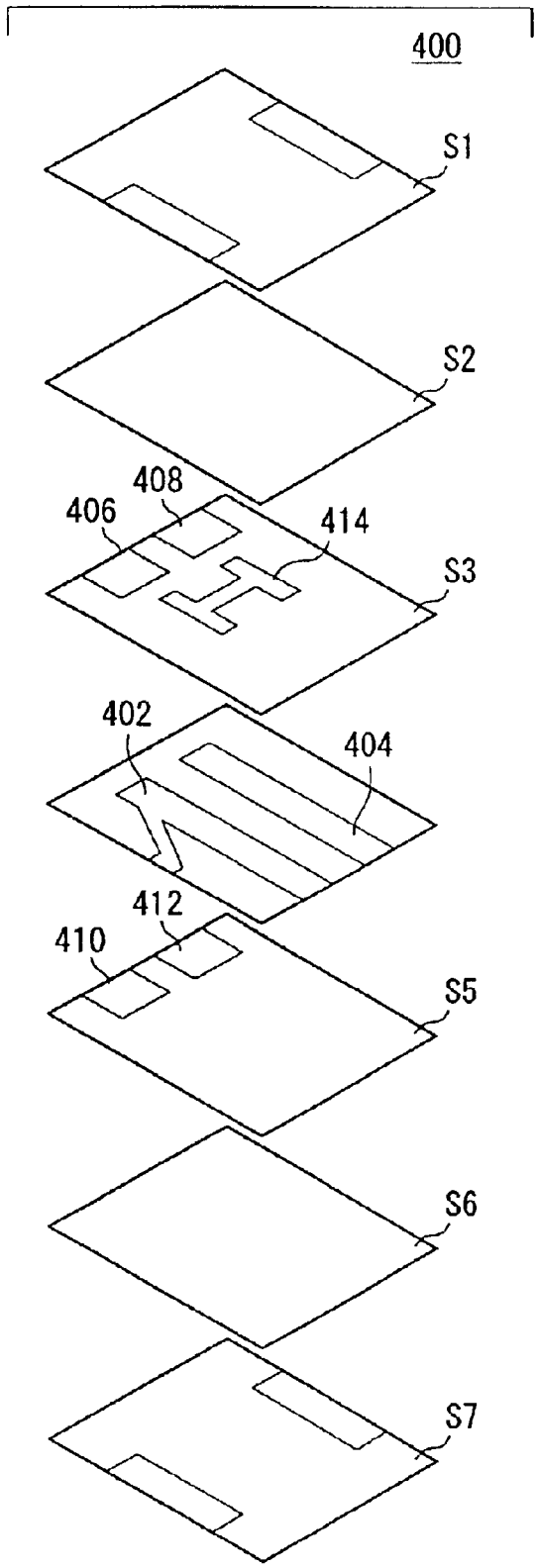
FIG. 30 shows an exploded perspective view illustrating a conventional stacked dielectric filter.

The Comparative Example was a stacked dielectric filter of the unbalanced type. Specifically, the stacked dielectric filter of the unbalanced type was constructed in the same manner as the filter 400 shown in FIG. 30. The Working Example was constructed in the same manner as the filter 10A described above.

Figure 3:
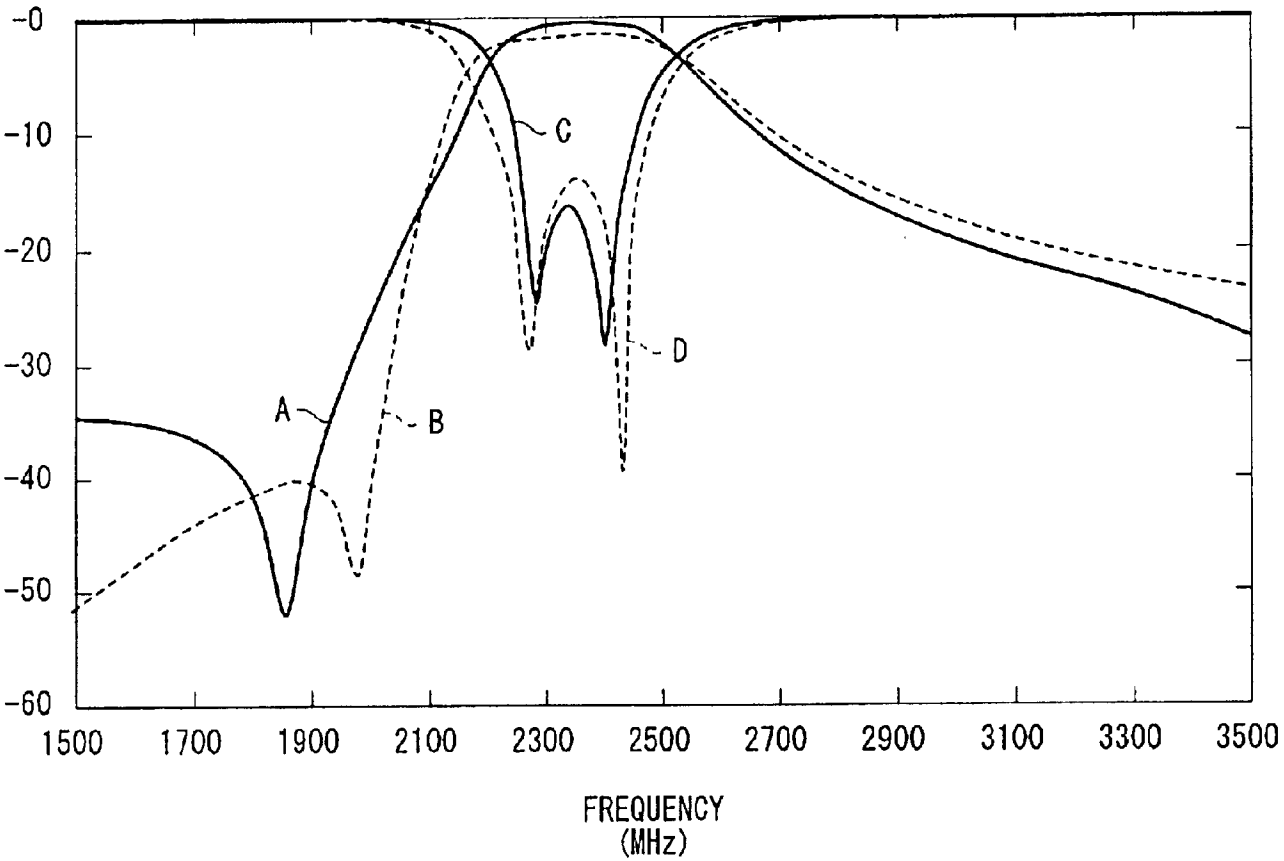
FIG. 3 shows the bandpass characteristics and the reflection characteristics of Comparative Example and Working Example.

Experimental results are shown in FIG. 3. In FIG. 3, Solid Line A indicates the bandpass characteristic of the Comparative Example, and Broken Line B indicates the bandpass characteristic of the Working Example. Solid Line C indicates the reflection characteristic of the Comparative Example, and Broken Line D indicates the reflection characteristic of the Working Example. The characteristics of the Comparative Example were illustrative of the results obtained by performing the measurement without using a balun.

According to the experimental results, it is understandable that the attenuation pole is located at the position close to the band of use, signals in regions other than the bandpass region can be efficiently attenuated, and the reflection is reduced in the Working Example as compared with the Comparative Example. It is clear that the characteristics are further deteriorated when the balun is separately connected to the filter of the Comparative Example. On the contrary, it is understandable that the characteristics are remarkably improved in the Working Example as compared with the Comparative Example, because it is unnecessary to separately connect the balun in the Working Example.

Next, explanation will be made with reference to an equivalent circuit shown in FIG. 4 for the adjustment of the output impedance, the level balance, and the phase balance of the converting section 28 of the filter 10A.

Figure 4:
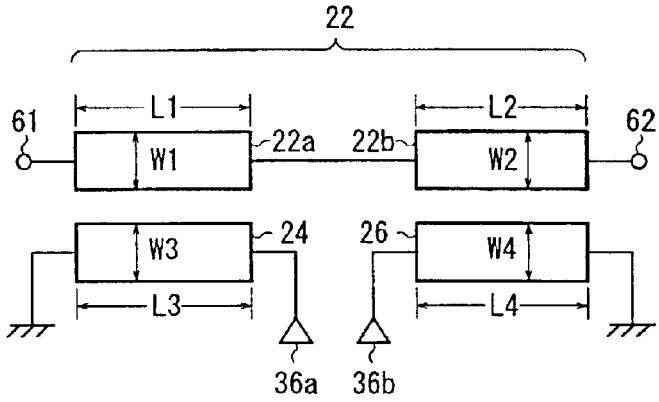
FIG. 4 shows an equivalent circuit of a converting section of the stacked dielectric filter according to the first embodiment.

The equivalent circuit shown in FIG. 4 is illustrative of the converting section 28 of the filter 10A. As for the first strip line 22, the portion (first portion 22*a*) corresponding to the second strip line 24 and the portion (second portion 22*b*) corresponding to the third strip line 26 are connected in series. The first end (terminal end 62) of the second portion 22*b* is the open end.

The second strip line 24 is connected between GND and the first balanced output terminal 36*a*, and the third strip line 26 is connected between GND and the second balanced output terminal 36*b*.

The level balance herein refers to whether an identical signal level (absolute value) is outputted from the first and second balanced output terminals 36*a*, 36*b*. The phase balance herein refers to whether phases of signals outputted from the first and second balanced output terminals 36*a*, 36*b* are related by 180°.

At first, the level balance can be adjusted by appropriately changing the widths W3, W4 of the second and third strip lines 24, 26. For example, it is assumed that the first signal level outputted from the first balanced output terminal 36*a* is lower than the second signal level outputted from the second balanced output terminal 36*b*. When the width W3 of the second strip line 24 is widened, or when the width W4 of the third strip line 26 is narrowed, then the first signal level is raised, or the second signal level is lowered. Accordingly, it is possible to adjust the level balance.

Figure 5A:
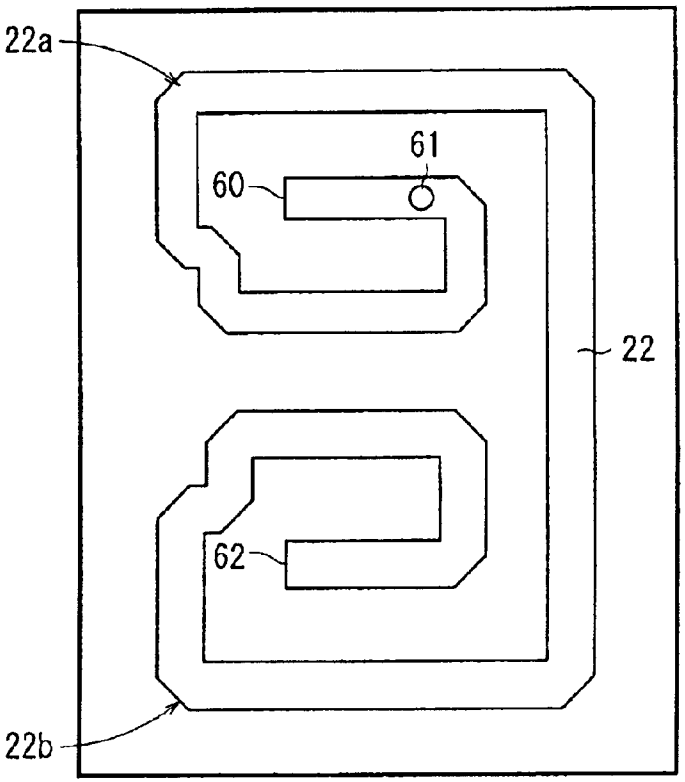
FIG. 5A illustrates an example in which the width of a first portion is narrowed in a first strip line.
Figure 5B:
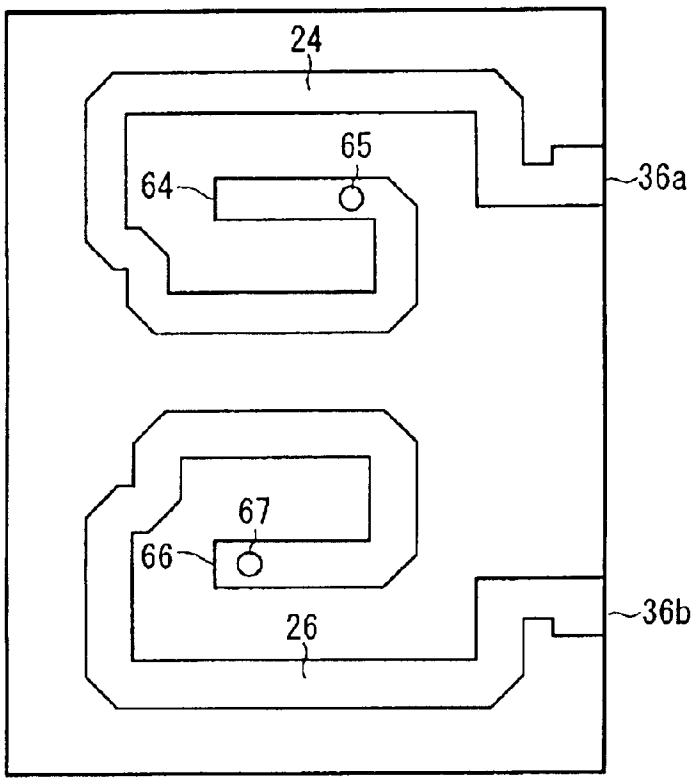
FIG. 5B illustrates an example in which the width of a second strip line of second and third strip lines is narrowed.

As for this feature, the level balance can be also adjusted by appropriately changing the width W1 of the first portion 22*a* of the first strip line 22 or the width W2 of the second portion 22*b*. FIGS. 5A and 5B are illustrative of the case in which the width W1 of the first portion 22*a* of the first strip line 22 and the width W3 of the second strip line 24 are narrowed.

When the level balance is adjusted, the phase difference between the first and second signal levels may be deviated from 180°. Accordingly, the phase balance can be adjusted by appropriately changing any one or more electrically effective length or lengths of the electrically effective length L1 of the first portion 22*a* of the first strip line 22, the electrically effective length L2 of the second portion 22*b*, the electrically effective length L3 of the second strip line 24, and the electrically effective length L4 of the third strip line 26.

When the electrically effective length L1 of the first portion 22*a* is changed, the first connection position 61 on the first strip line 22 may be appropriately changed. When the electrically effective length L2 of the second portion 22*b* is changed, the position of the terminal end 62 may be changed. When the electrically effective length L3 of the second strip line 24 is changed, the connection portion 65 on the second strip line 24 may be appropriately changed. When the electrically effective length L4 of the third strip line 26 is changed, the third connection portion 67 on the third strip line 26 may be appropriately changed.

On the other hand, the output impedance of the converting section 28 can be also easily adjusted by appropriately changing the widths W1, W2 and the electrically effective lengths L1, L2 of the first and second portions 22*a*, 22*b* of the first strip line 22 described above, the width W3 and the electrically effective length L3 of the second strip line 24, and the width W4 and the electrically effective length L4 of the third strip line 26. However, the output impedance of the converting section 28 can be easily adjusted as well by changing the dielectric constant of the eighth dielectric layer S8 existing between the first strip line 22 and the second and third strip lines 24, 26.

Figure 6:
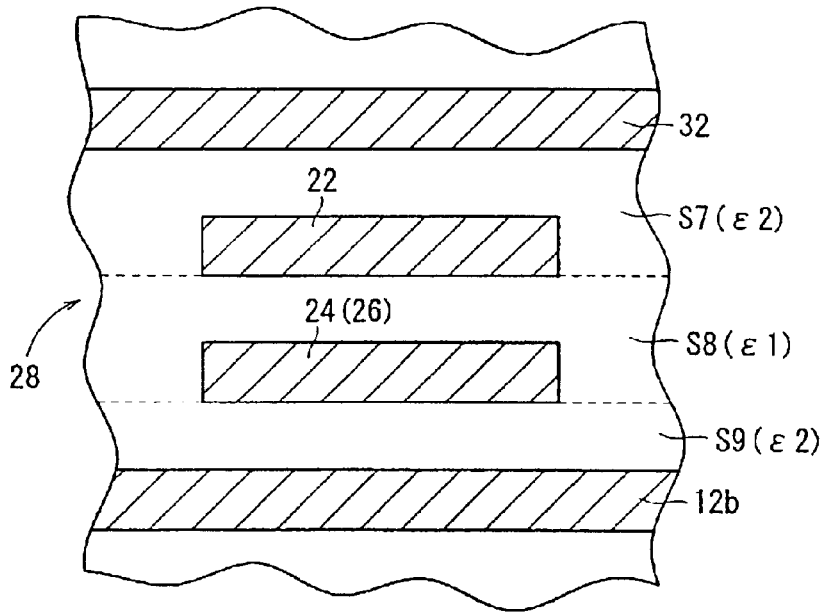
FIG. 6 illustrates the relationship of respective dielectric constants of stacked dielectric layers in the converting section.

For example, as shown in FIG. 6, it is assumed that $\in 1$ represents the dielectric constant of the eighth dielectric layer S8, and $\in 2$ represents the respective dielectric constants of the seventh dielectric layer S7 and the ninth dielectric layer S9. When $\in 1 < \in 2$ is established, the output impedance of the converting section 28 is raised. When $\in 1 > \in 2$ is established, the output impedance is lowered.

Figure 7:
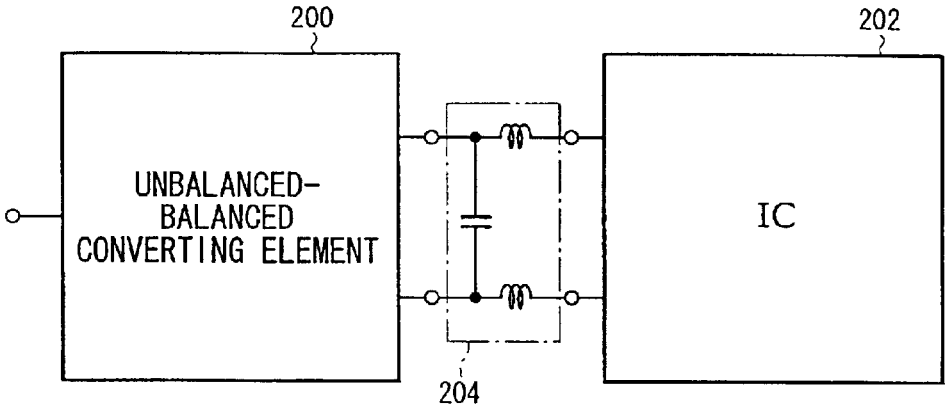
FIG. 7 shows a circuit diagram illustrating a form of use adopted when an IC is connected to an unbalanced-balanced converting element.

Usually, as shown in FIG. 7, the output impedance of the unbalanced-balanced converting element 200 is twice the input impedance of the unbalanced-balanced converting element 200. For example, when the input impedance of the unbalanced-balanced converting element 200 is 50Ω, the output impedance is 100Ω. However, assuming that an IC 202 is connected to the unbalanced-balanced converting element 200, when the impedance necessary to effect the matching to the IC 202 is, for example, 50Ω, the impedance matching is not satisfied. It is necessary to additionally provide a circuit 204 for effecting the impedance matching between the unbalanced-balanced converting element 200 and the IC 202.

Figure 8:
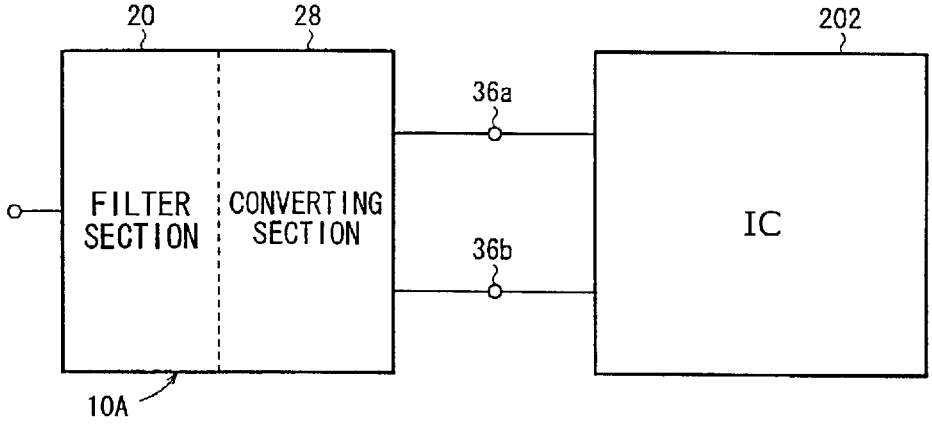
FIG. 8 shows a circuit diagram illustrating a form of use adopted when an IC is connected to the stacked dielectric filter according to the first embodiment.

However, in the case of the filter 10A, even when the input impedance of the converting section 28 is 50Ω as described above, the output impedance of the converting section 28 can be easily matched to the input impedance of the IC 202 by appropriately setting the various parameters described above. As shown in FIG. 8, it is unnecessary to connect any additional matching circuit, and it is possible to directly connect the IC 202 to the output terminal of the converting section 28. This results in the miniaturization of the circuit system including the filter 10A and the IC.

Figure 9:
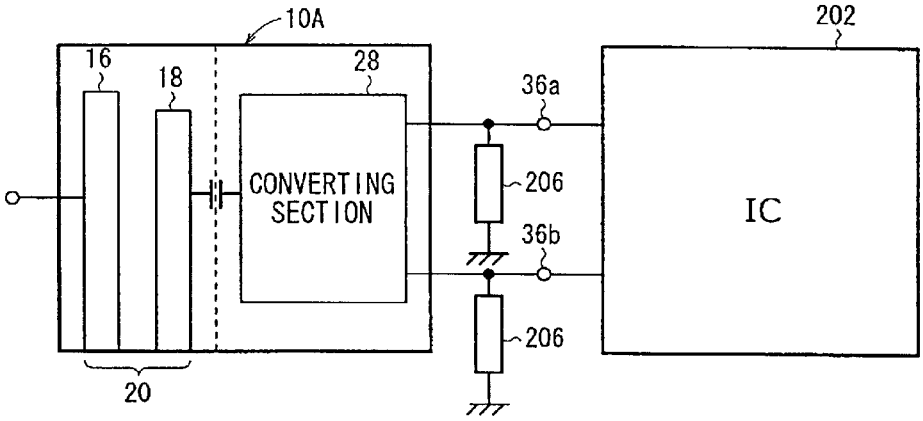
FIG. 9 shows a circuit diagram illustrating an example in which an apparent reactance circuit is equivalently connected to the output side of the converting section.
Figure 10:
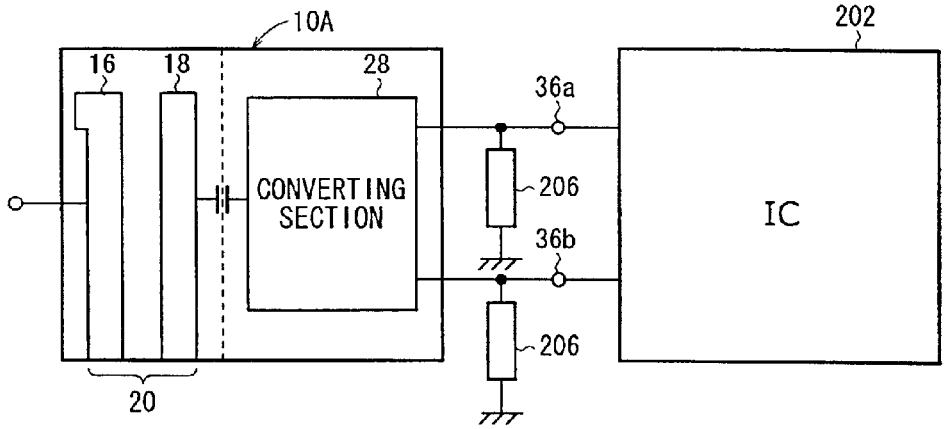
FIG. 10 shows a circuit diagram illustrating another example in which an apparent reactance circuit is equivalently connected to the output side of the converting section.

The technique for adjusting the output impedance of the converting section 28 includes the setting of the various parameters as described above, and a method for equivalently connecting an apparent reactance circuit 206 (see FIGS. 9 and 10) to the output side of the converting section 28. This method can be realized by allowing the plurality of resonators of the filter section 20 to have different resonance frequencies. For example, as shown in FIG. 9, the physical length of the output side resonant electrode 18 is shorter than the physical length of the input side resonant electrode 16. Further, for example, as shown in FIG. 10, the area of the open end of the input side resonant electrode 16 is larger than the area of the open end of the output side resonant electrode 18.

Accordingly, for example, when the filter section 20 is a single unit, the filter section 20 operates as if the reactance circuit is connected for making the resonance frequencies of the resonators equivalent. However, in the first embodiment, the filter section 20 and the converting section 28 are integrated into one unit. Therefore, the reactance circuit 206 operates as if the reactance circuit 206 is connected to the output terminal of the converting section 28. The reactance circuit 206 contributes to the adjustment of the output impedance of the converting section 28.

Figure 11:
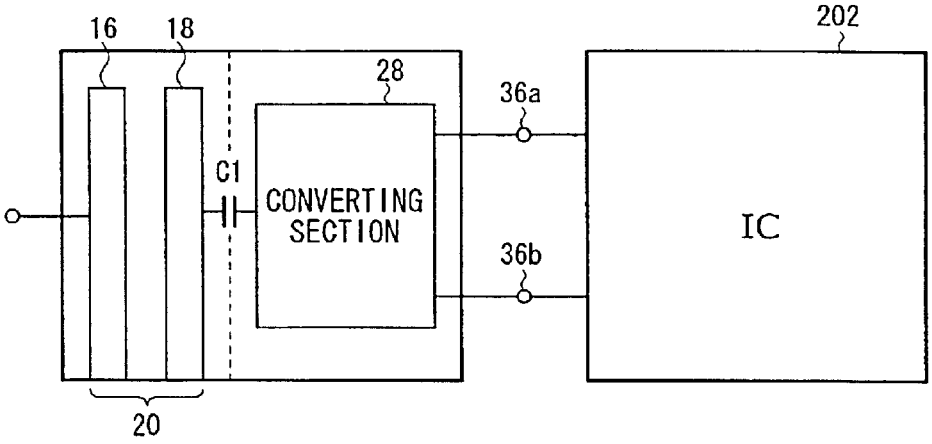
FIG. 11 shows a circuit diagram illustrating an example of the method for adjusting the input impedance of the converting section.

In the filter 10A, the filter section 20 and the converting section 28 are integrated into one unit as described above. Therefore, it is unnecessary to set a specified value (for example, 50Ω) for the characteristic impedance between the filter section 20 and the converting section 28. In other words, it is possible to set a value other than 50Ω for the input impedance of the converting section 28. For example, as shown in FIG. 11, the input impedance of the converting section 28 can be adjusted to have an arbitrary value by appropriately changing the capacitance value of the capacitor C1 formed between the output side resonant electrode 18 (or second output side resonant electrode 18*b* in FIG. 2) of the filter section 20 and the output capacitor electrode 50 of the connecting section 30.

Figure 12:
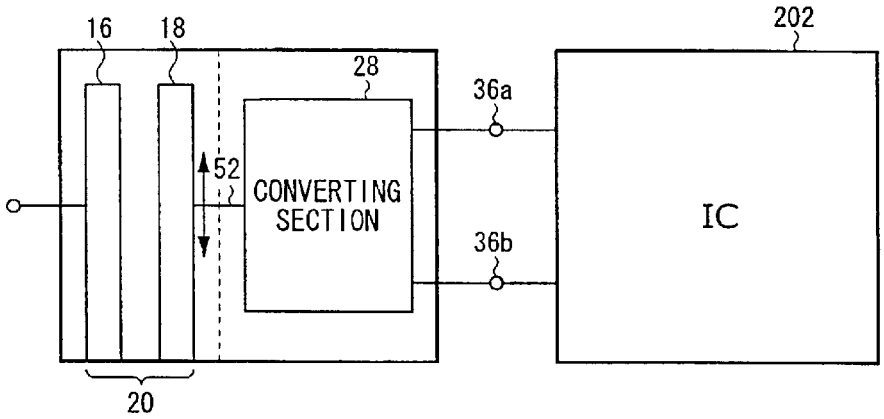
FIG. 12 shows a circuit diagram illustrating another example of the method for adjusting the input impedance of the converting section.

When the output side resonant electrode 18 (18*b*) of the filter section 20 is directly connected through the via-hole 52 to the connecting electrode 54 of the connecting section 30 as shown in FIG. 2, the input impedance of the converting section 28 can be adjusted to have an arbitrary value by appropriately changing the connection position of the via-hole 52 with respect to the output side resonant electrode 18 as shown in FIG. 12.

Next, a modified embodiment of the filter 10A will be explained with reference to FIGS. 13 to 16.

A filter 10A*a* is constructed in approximately the same manner as the filter 10A described above. However, as illustrated in an equivalent circuit shown in FIG. 13, the former is different from the latter in that a DC power source is connected to the second and third strip lines 24, 26 in the converting section 28.

Figure 14:
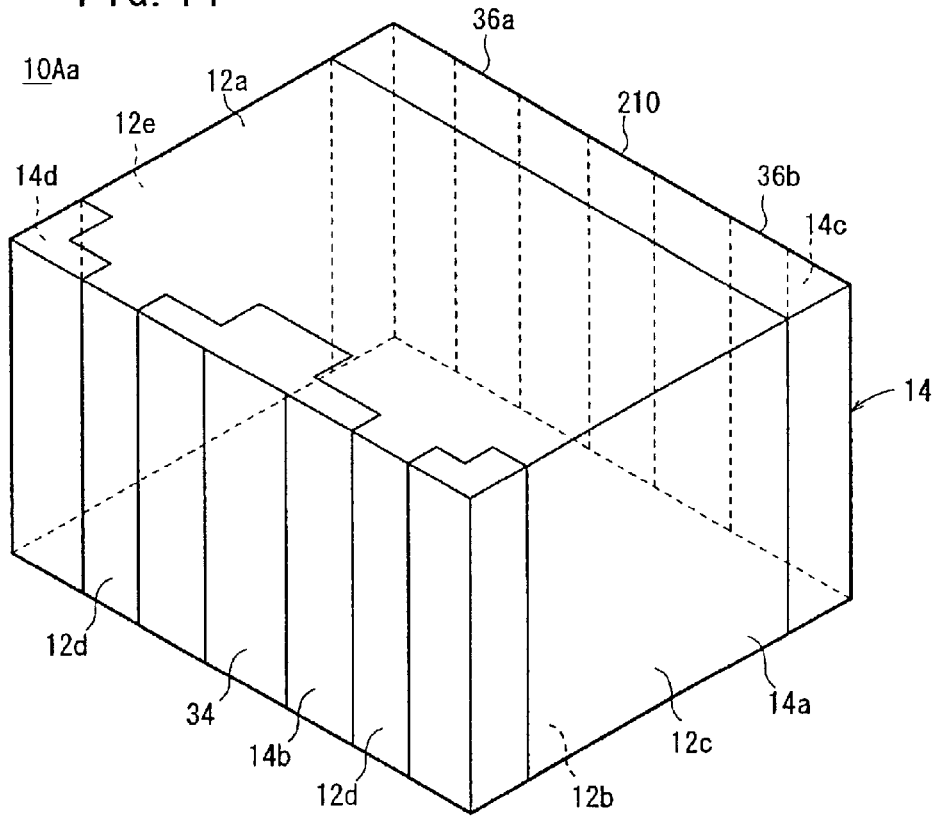
FIG. 14 shows a perspective view illustrating the modified embodiment of the stacked dielectric filter according to the first embodiment.

Specifically, as shown in FIG. 14, a DC electrode 210, which is connected to the DC power source, is formed at a portion of the third side surface 14*c* of the dielectric substrate 14 between the first and second balanced output terminals 36*a*, 36*b*.

Figure 15:
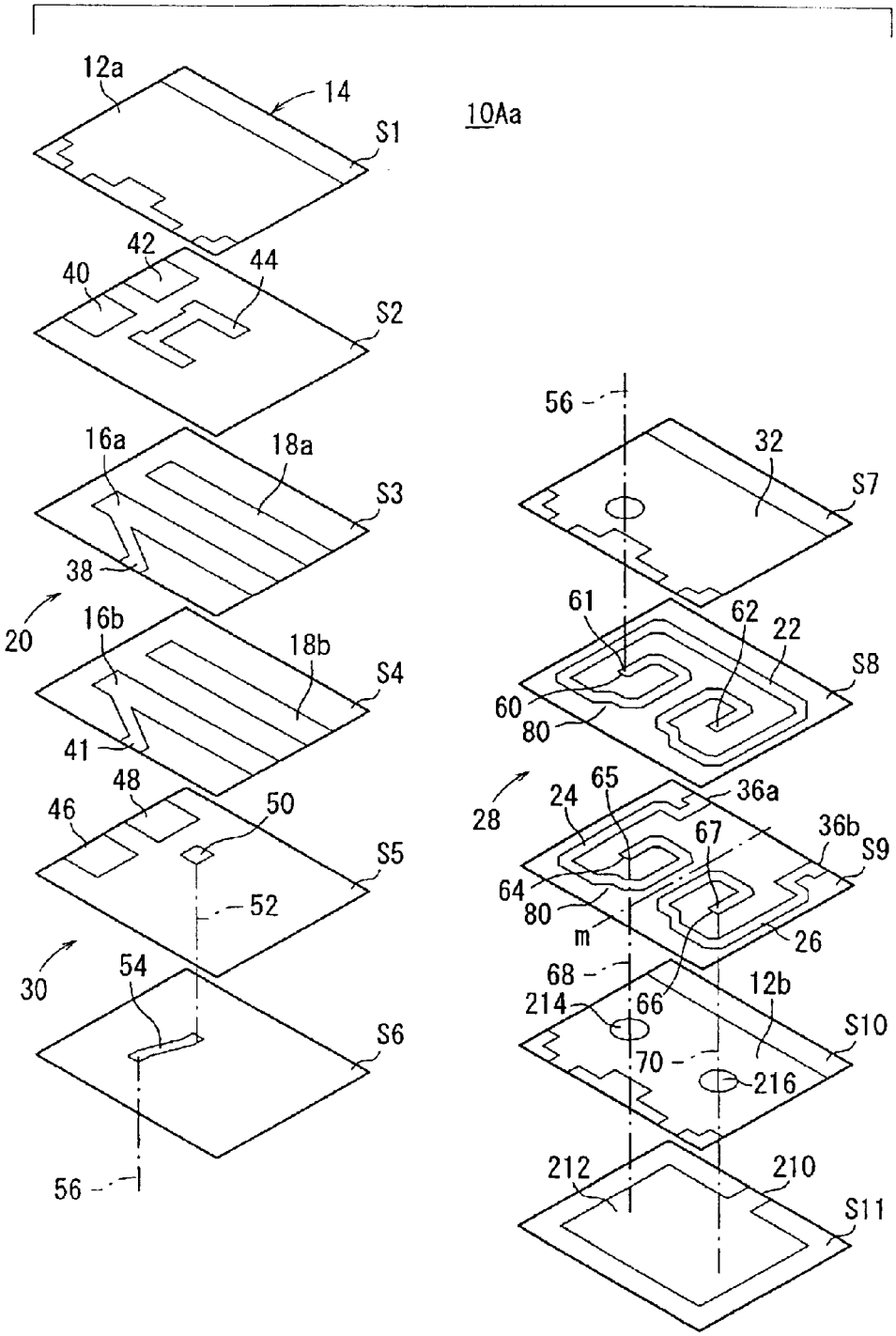
FIG. 15 shows an exploded perspective view illustrating the modified embodiment of the stacked dielectric filter according to the first embodiment.

Further, as shown in FIG. 15, an inner layer DC electrode 212, which is connected to the DC electrode 210, is formed on a first principal surface of an eleventh dielectric layer S11 positioned under the tenth dielectric layer S10. The second connection portion 65 of the second strip line 24 and the third connection portion 67 of the third strip line 26 are connected to the inner layer DC electrode 212 through the via-holes 68, 70 respectively. In this arrangement, areas 214, 216 for insulating the via-holes 68, 70 from the ground electrode 12*b* are formed on the first principal surface of the tenth dielectric layer S10.

Figure 13:
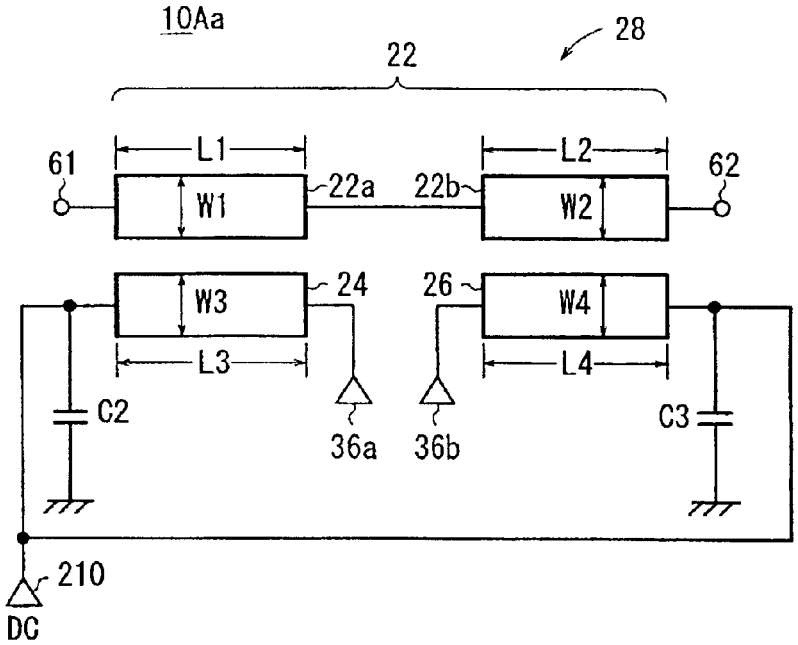
FIG. 13 shows an equivalent circuit of a converting section of a modified embodiment of the stacked dielectric filter according to the first embodiment.

Accordingly, as shown in FIG. 13, the DC power source is connected at the second and third connection portions 65, 67 of the second and third strip lines 24, 26 respectively. Further, capacitors C2, C3 are formed between the second and third strip lines 24, 26 and the ground electrode 12*b* (GND).

Figure 16:
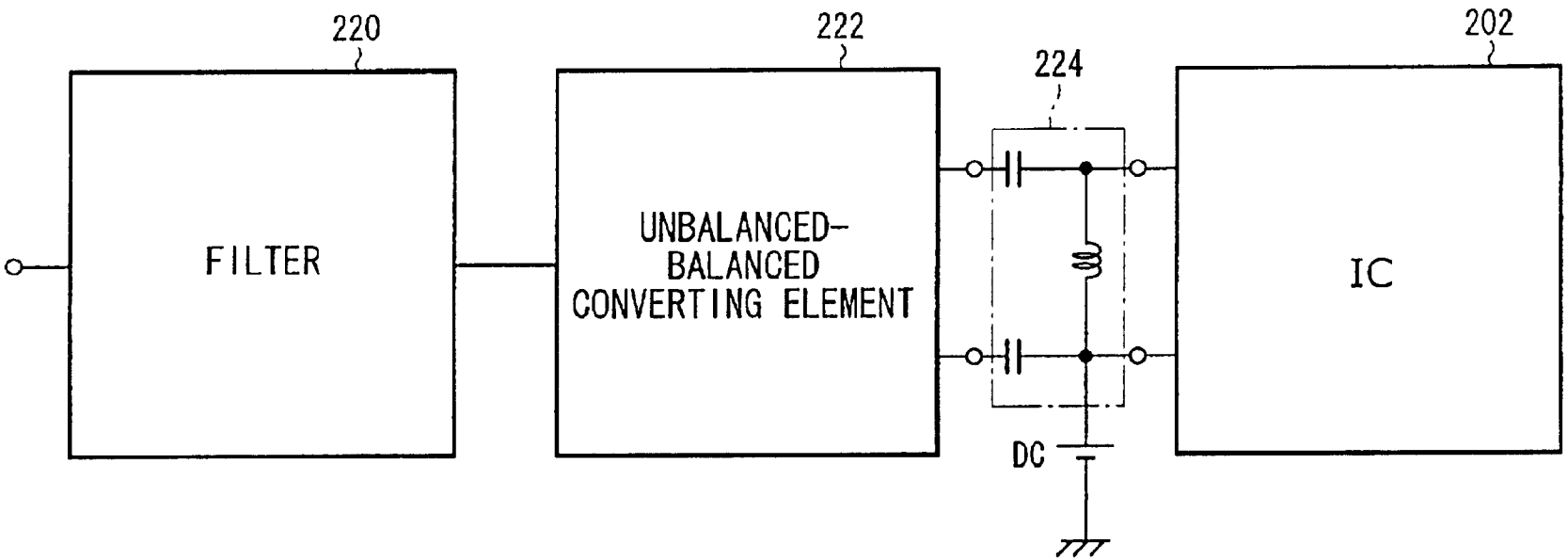
FIG. 16 illustrates a general form of use of the stacked dielectric filter.

Explanation will now be made for use of the stacked dielectric filter. In general, when the stacked dielectric filter is used, for example, as shown in FIG. 16, the unbalanced-balanced converting element 222 is connected to the stacked dielectric filter 220, and the IC 202 is further connected to the unbalanced-balanced converting element 222. In this case, a DC voltage is separately supplied to the IC 202.

Usually, as shown in FIG. 16, it is necessary to provide a dedicated circuit 224 for supplying the DC voltage between the stacked dielectric filter 220 and the IC 202. However, it is unnecessary to connect the dedicated circuit 224 with the present invention, because the balanced signal, in which the received signal component is superimposed on the DC voltage, is outputted from the converting section 28 of the filter 10A*a* shown in FIGS. 13 to 15 described above. Therefore, it is possible to realize the miniaturization of the circuit system including the filter 10A*a* and the IC 202.

Next, a stacked dielectric filter 10B according to a second embodiment will be explained with reference to FIGS. 17 and 18.

Figure 17:
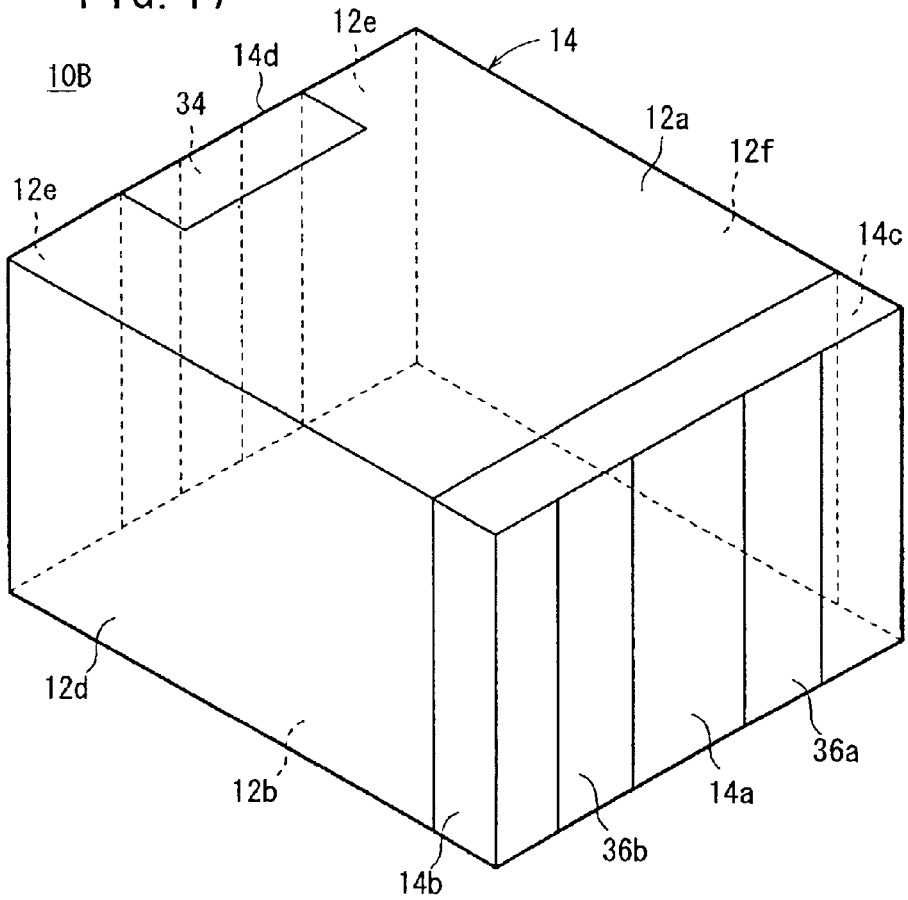
FIG. 17 shows a perspective view illustrating a stacked dielectric filter according to a second embodiment.

As shown in FIG. 17, the filter 10B has a dielectric substrate 14. The dielectric substrate 14 is constructed by stacking, sintering, and integrating a plurality of dielectric layers (S1 to S12, see FIG. 18) into one unit. Ground electrodes 12*a*, 12*b* are formed on both principal surfaces of the dielectric substrate 14 (first principal surface of the first dielectric layer S1 and first principal surface of the twelfth dielectric layer S12) respectively.

Figure 18:
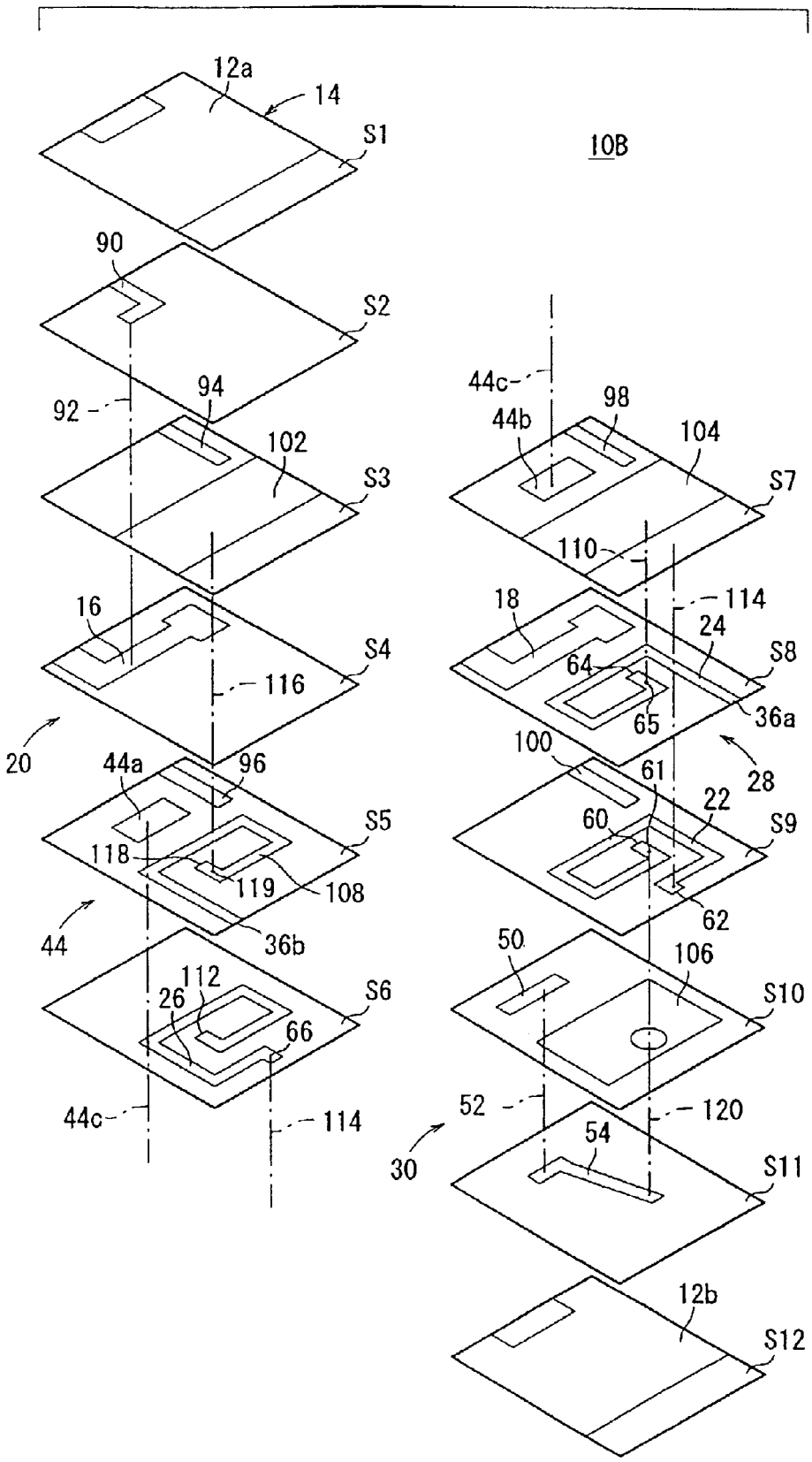
FIG. 18 shows an exploded perspective view illustrating the stacked dielectric filter according to the second embodiment.

As shown in FIG. 18, a filter section 20 is formed at a left portion of the dielectric substrate 14 in the stacking direction of the dielectric layers S1 to S12, a converting section 28 is formed at a right portion in the stacking direction, and a connecting section 30 is formed at a lower portion in the stacking direction.

As shown in FIG. 17, an unbalanced input terminal 34 is formed at a central portion of a fourth side surface 14*d* of the outer circumferential surface of the dielectric substrate 14, and ground electrodes 12*e* are formed on both sides of the unbalanced input terminal 34. First and second balanced output terminals 36*a*, 36*b* are formed on a first side surface 14*a* disposed on the side opposite to the fourth side surface 14*d*. Ground electrodes 12*d*, 12*f* are formed on second and third side surfaces 14*b*, 14*c* respectively. There are areas for insulating the unbalanced input terminal 34 and the balanced output terminals 36*a*, 36*b* from the ground electrodes (including inner layer ground electrodes described later on).

As shown in FIG. 18, the filter section 20 has an input side resonant electrode 16 (¼ wavelength input side resonator) which is formed on the first principal surface of the fourth dielectric layer S4, and an output side resonant electrode 18 (¼ wavelength output side resonator) which is formed on the first principal surface of the eighth dielectric layer S8. Each of the resonant electrodes 16, 18 has an L-shaped configuration in which the pattern is bent at an intermediate position. Respective short circuit ends are connected to the ground electrode 12*e* on the fourth side surface 14*d* (see FIG. 17), and respective open ends are formed to be wider than intermediate portions.

An input electrode 90, which has a first end connected to the unbalanced input terminal 34, is formed on the first principal surface of the second dielectric layer S2. The input electrode 90 is electrically connected to the input side resonant electrode 16 through a via-hole 92 which is formed between the second and third dielectric layers S2, S3.

An inner layer ground electrode 94 is formed on the first principal surface of the third dielectric layer S3. The inner layer ground electrode 94 has a first end which is connected to the ground electrode 12*e*. The third dielectric layer S3 is interposed between the inner layer ground electrode 94 and the open end of the input side resonant electrode 16.

A first electrode 44*a* of a coupling-adjusting electrode 44 and an inner layer ground electrode 96 are formed on the first principal surface of the fifth dielectric layer S5. The fourth dielectric layer S4 is interposed between the first electrode 44*a* and the input side resonant electrode 16. The inner layer ground electrode 96 has a first end which is connected to the ground electrode 12*e*. The fourth dielectric layer S4 is interposed between the inner layer ground electrode 96 and the open end of the input side resonant electrode 16.

A second electrode 44*b* of the coupling-adjusting electrode 44 and an inner layer ground electrode 98 are formed on the first principal surface of the seventh dielectric layer S7. The seventh dielectric layer S7 is interposed between the second electrode 44*b* and the output side resonant electrode 18. The inner layer ground electrode 98 has a first end which is connected to the ground electrode 12*e*. The seventh dielectric layer S7 is interposed between the inner layer ground electrode 98 and the open end of the output side resonant electrode 18.

An inner layer ground electrode 100 is formed on the first principal surface of the ninth dielectric layer 90. The inner layer ground electrode 100 has a first end which is connected to the ground electrode 12*e*. The eighth dielectric layer S8 is interposed between the inner layer ground electrode 100 and the open end of the output side resonant electrode 18.

The coupling-adjusting electrode 44 is constructed by the first electrode 44*a*, the second electrode 44*b*, and the via-hole 44*c*. The via-hole 44*c* is formed in a region ranging over the fifth and sixth dielectric layers S5, S6, and the via-hole 44*c* electrically connects the first and second electrodes 44*a*, 44*b*.

Additionally, the converting section 28 has inner layer ground electrodes 102, 104, 106, and first to fourth strip lines 22, 24, 26, 108. The inner layer ground electrode 102 is formed on the first principal surface of the third dielectric layer S3, the inner layer ground electrode 104 is formed on the first principal surface of the seventh dielectric layer S7, and the inner layer ground electrode 106 is formed on the first principal surface of the tenth dielectric layer S10. The first strip line 22 is formed on the first principal surface of the ninth dielectric layer S9, the second strip line 24 is formed on the first principal surface of the eighth dielectric layer S8, the third strip line 26 is formed on the first principal surface of the sixth dielectric layer S6, and the fourth strip line 108 is formed on the first principal surface of the fifth dielectric layer S5.

The first strip line 22 is configured to be patterned in a spiral form from a first start end 60 to a terminal end 62 (position disposed closely to the first side surface 14*a* of the dielectric substrate 14). A second end of the connecting electrode 54 described above is electrically connected through a via-hole 120 at the first start end 60 or at a position in the vicinity of the first start end 60 (first connection position 61) of the first strip line 22.

The second strip line 24 is configured to be patterned in a spiral form toward the first balanced output terminal 36*a* from a second start end 64 formed at a position corresponding to the first start end 60 of the first strip line 22. The inner layer ground electrode 104 is electrically connected through a via-hole 110 at the second start end 64 or at a position in the vicinity of the second start end 64 (second connection portion 65) of the second strip line 22.

The third strip line 26 is configured to be converged in a spiral form to a terminal end 112 from a third start end 66 corresponding to the terminal end 62 of the first strip line 22 described above. The terminal end 62 of the first strip line 22 and the third start end 66 of the third strip line 26 are electrically connected to one another through a via-hole 114 formed in a region ranging over the sixth to eighth dielectric layers S6 to S8.

The fourth strip line 108 is configured to be patterned in a spiral form toward the second balanced output terminal 36*b* from a fourth start end 118 formed at a position corresponding to the terminal end 112 of the third strip line 26. The fourth strip line 108 is electrically connected to the inner layer ground electrode 102 through a via-hole 116 at the fourth start end 118 or at a position in the vicinity of the fourth start end 118 (third connection position 119) of the fourth strip line 108.

In other words, in the converting section 28, one coupling line of the first strip line 22 and the second strip line 24 is separated by the inner layer ground electrode 104 from the other coupling line of the third strip line 26 and the fourth strip line 108.

The connecting section 30 has an output capacitor electrode 50 and the connecting electrode 54. The output capacitor electrode 50 is formed at a position opposed to a central portion of the output side resonant electrode 18 on the first principal surface of the tenth dielectric layer S10. The connecting electrode 54 is formed on the first principal surface of the eleventh dielectric layer S11. A first end of the connecting electrode 54 is connected to the output capacitor electrode 50 through a via-hole 52. A second end of the connecting electrode 54 is connected to the first connection position 61 of the first strip line 22 through a via-hole 120. There is an area for insulating the via-hole 120 from the inner layer ground electrode 106, i.e., an area in which no electrode film is formed.

In the filter 10B, it is possible to effectively realize the miniaturization, and it is possible to increase the degree of flexibility of designing of each of the components in the same manner as in the filter 10A.

In the converting section 28; the one coupling line of the first and second strip lines 22, 24 is separated by the inner layer ground electrode 104 from the other coupling line of the third and fourth strip lines 26, 108. Therefore, unnecessary coupling is not formed between the filter section 20 and the converting section 28, even though the filter section 20 is not isolated from the converting section 28. Consequently, it is possible to suppress the interference between the coupling lines, and it is possible to obtain the good balance of the input/output characteristics in the converting section 28.

Also in the filter 10B, the planes, on which the respective resonant electrodes 16, 18 of the input side resonator and the output side resonator are formed, are parallel to the planes on which the ground electrodes 12*a*, 12*b*, are formed in the same manner as in the filter 10A. The plane, on which the unbalanced input terminal 34 of the filter section 20 is formed, is perpendicular to the planes on which the respective strip lines 22, 24, 26, 108 of the converting section 28 are formed. The unbalanced input terminal 34 is formed at the position separated from the respective strip lines 22, 24, 26, 108. Accordingly, it is possible to eliminate any unnecessary interference between the unbalanced input terminal 34 and the respective strip lines 22, 24, 26, 108. It is therefore unnecessary to provide any relief 80 as shown in FIG. 2 for the respective strip lines 22, 24, 26, 108. This results in the improvement in characteristics.

Also in the filter 10B, the output impedance, the level balance, and the phase balance of the converting section 28 can be adjusted by appropriately changing the widths and the electrically effective lengths of the first to fourth strip lines 22, 24, 26, 108 and the dielectric constants of the third to ninth dielectric layers S3 to S9.

When the electrically effective length of the first strip line 22 requires change, that change can be easily realized by appropriately changing the first connection position 61 on the first strip line 22. When the electrically effective length of the second strip line 24 requires change, that change can be easily realized by appropriately changing the second connection portion 65.

When the electrically effective length of the third strip line 26 requires change, that change can be easily realized by changing the position of the terminal end 112 of the third strip line 26. When the electrically effective length of the fourth strip line 108 requires change, that change can be easily realized by appropriately changing the third connection position 119 on the fourth strip line 108.

Figure 19:
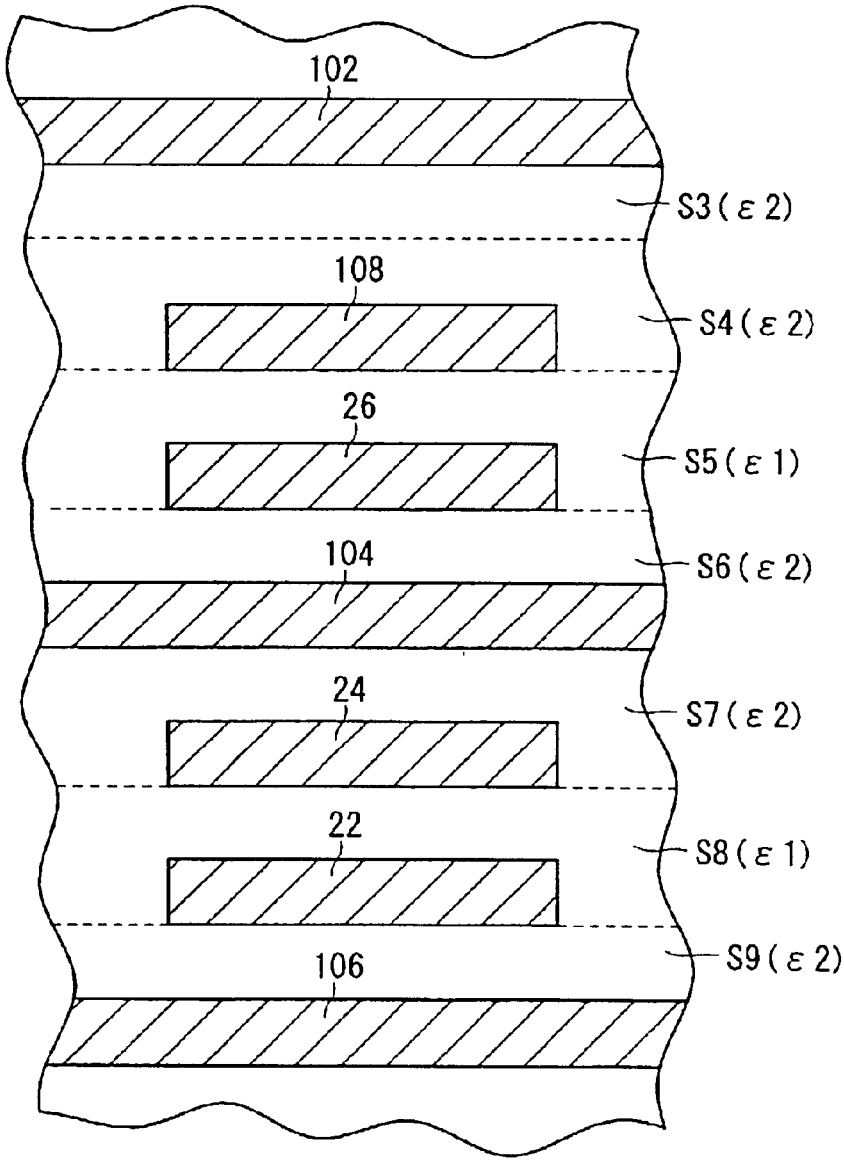
FIG. 19 illustrates the relationship of respective dielectric constants of stacked dielectric layers in a converting section.

For example, as shown in FIG. 19, it is assumed that $\in 1$ represents the dielectric constants of the fifth and eighth dielectric layers S5, S8, and $\in 2$ represents the respective dielectric constants of the third, fourth, sixth, seventh, and ninth dielectric layers S3, S4, S6, S7, S9. When $\in 1 < \in 2$ is established, the output impedance of the converting section 28 is raised. When $\in 1 > \in 2$ is established, the output impedance is lowered.

Also in the filter 10B, an arrangement can be adopted, in which an apparent reactance circuit is equivalently connected to the output terminal of the converting section 28. Accordingly, the output impedance of the converting section 28 can be appropriately changed. Further, the input impedance of the converting section 28 can be adjusted to have an arbitrary value.

Next, a modified embodiment of the filter 10B will be explained with reference to FIGS. 20 and 21.

A filter 10B*a* is constructed in approximately the same manner as the filter 10B described above. However, the former is different from the latter in the following points.

Figure 20:
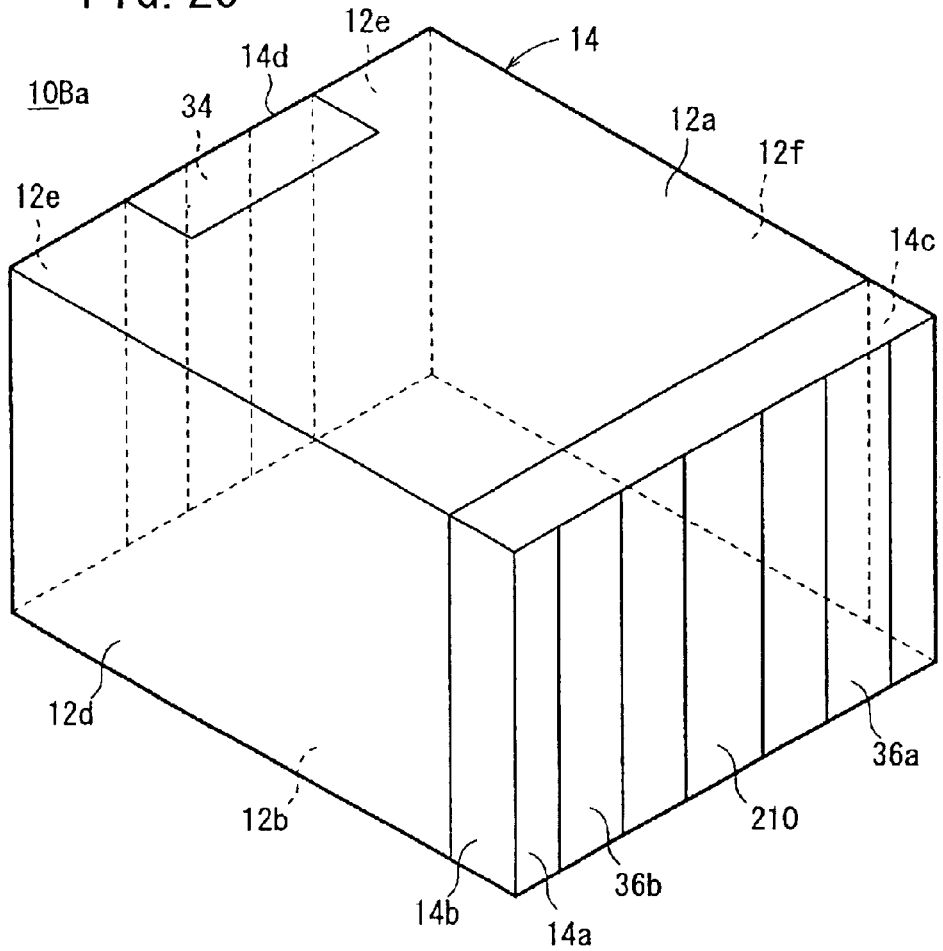
FIG. 20 shows a perspective view illustrating a modified embodiment of the stacked dielectric filter according to the second embodiment.

That is, as shown in FIG. 20, a DC electrode 210, which is connected to a DC power source, is formed between the first and second balanced output terminals 36*a*, 36*b* on the first side surface 14*a* of the dielectric substrate 14.

Figure 21:
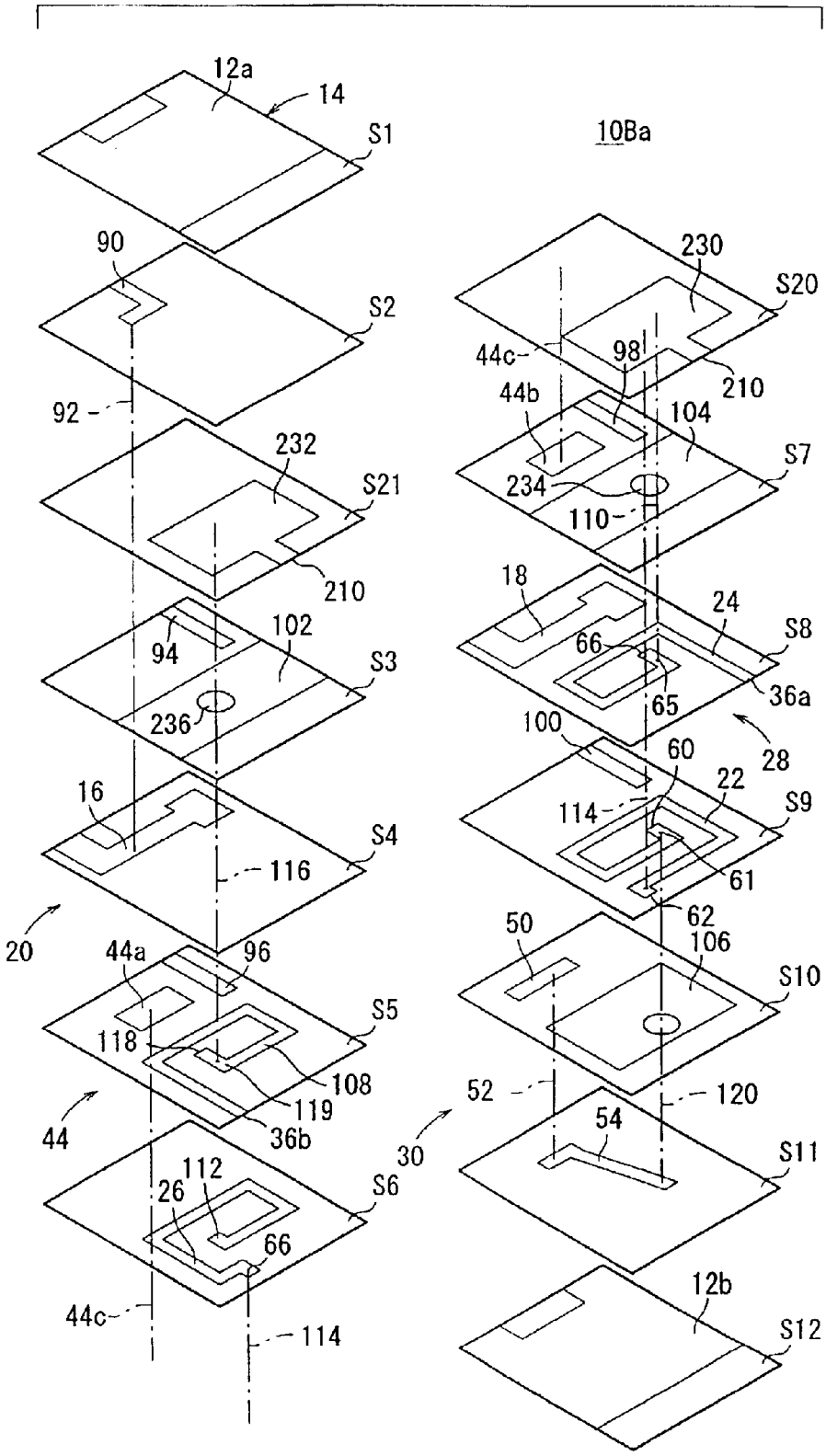
FIG. 21 shows an exploded perspective view illustrating the modified embodiment of the stacked dielectric filter according to the second embodiment.

Further, as shown in FIG. 21, a twentieth dielectric layer S20 is stacked between the sixth dielectric layer S6 and the seventh dielectric layer S7. A twenty-first dielectric layer S21 is stacked between the second dielectric layer S2 and the third dielectric layer S3. A first inner layer DC electrode 230 is formed on a first principal surface of the twentieth dielectric layer S20. The first inner layer DC electrode 230 is connected to the DC electrode 210. A second inner layer DC electrode 232 is formed on a first principal surface of the twenty-first dielectric layer S21. The first and second inner layer DC electrodes 230, 232 are connected to the DC electrode 210.

The second connection portion 65 of the second strip line 24 is connected to the first inner layer DC electrode 230 through the via-hole 110. The third connection position 119 of the fourth strip line 108 is connected to the second inner layer DC electrode 232 through the via-hole 116. In this arrangement, areas 234, 236 for insulating the via-holes 110, 116 from the inner layer ground electrodes 104, 102 are formed on the respective first principal surfaces of the seventh dielectric layer S7 and the third dielectric layer S3.

In the filter 10B*a*, when an IC of the type of the separate supply of the DC voltage is connected to the filter 10B*a*, the balanced signal, in which the received signal component is superimposed on the DC voltage, is outputted from the converting section 28. Therefore, it is unnecessary to connect any dedicated circuit for supplying the DC voltage to the IC 202. As a result, it is possible to realize the miniaturization of the circuit system including the filter 10B*a* and the IC 202.

Next, a stacked dielectric filter 10C according to a third embodiment will be explained with reference to FIGS. 22 and 23.

Figure 22:
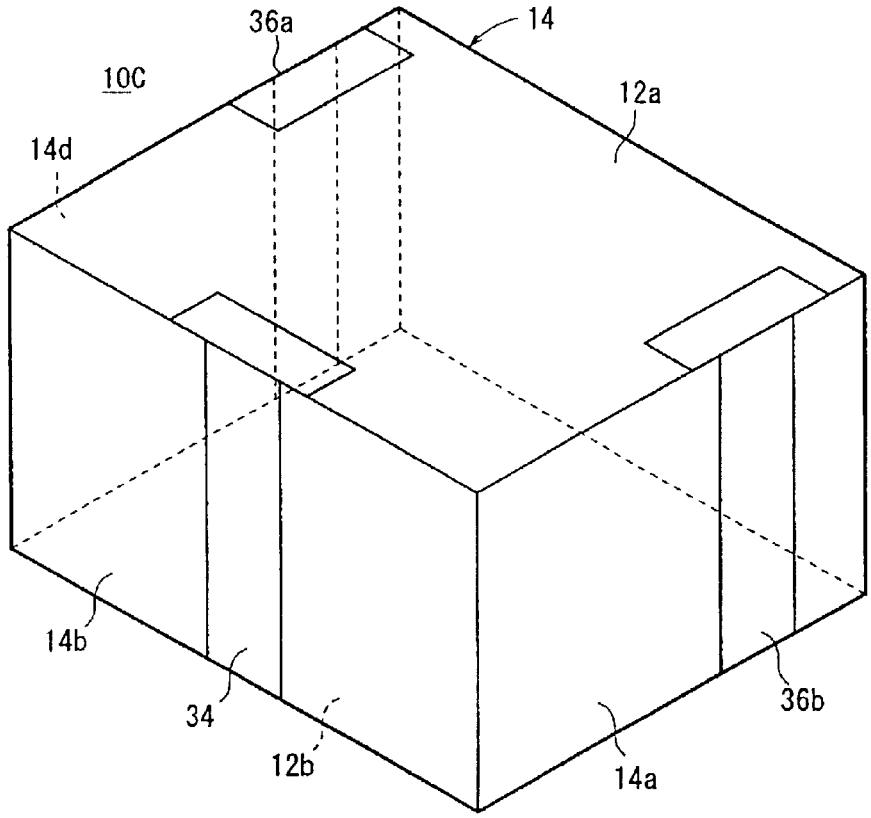
FIG. 22 shows a perspective view illustrating a stacked dielectric filter according to a third embodiment.

As shown in FIG. 22, the filter 10C has a dielectric substrate 14. The dielectric substrate 14 is constructed by stacking, sintering, and integrating a plurality of dielectric layers (S1 to S15, see FIG. 23) into one unit. Ground electrodes 12*a*, 12*b* are formed on both principal surfaces of the dielectric substrate 14 respectively. It is preferable that in the filter 10C, respective first principal surfaces of the first to fifteenth dielectric layers S1 to S15 are perpendicular to the planes on which the ground electrodes 12*a*, 12*b* are formed.

Figure 23:
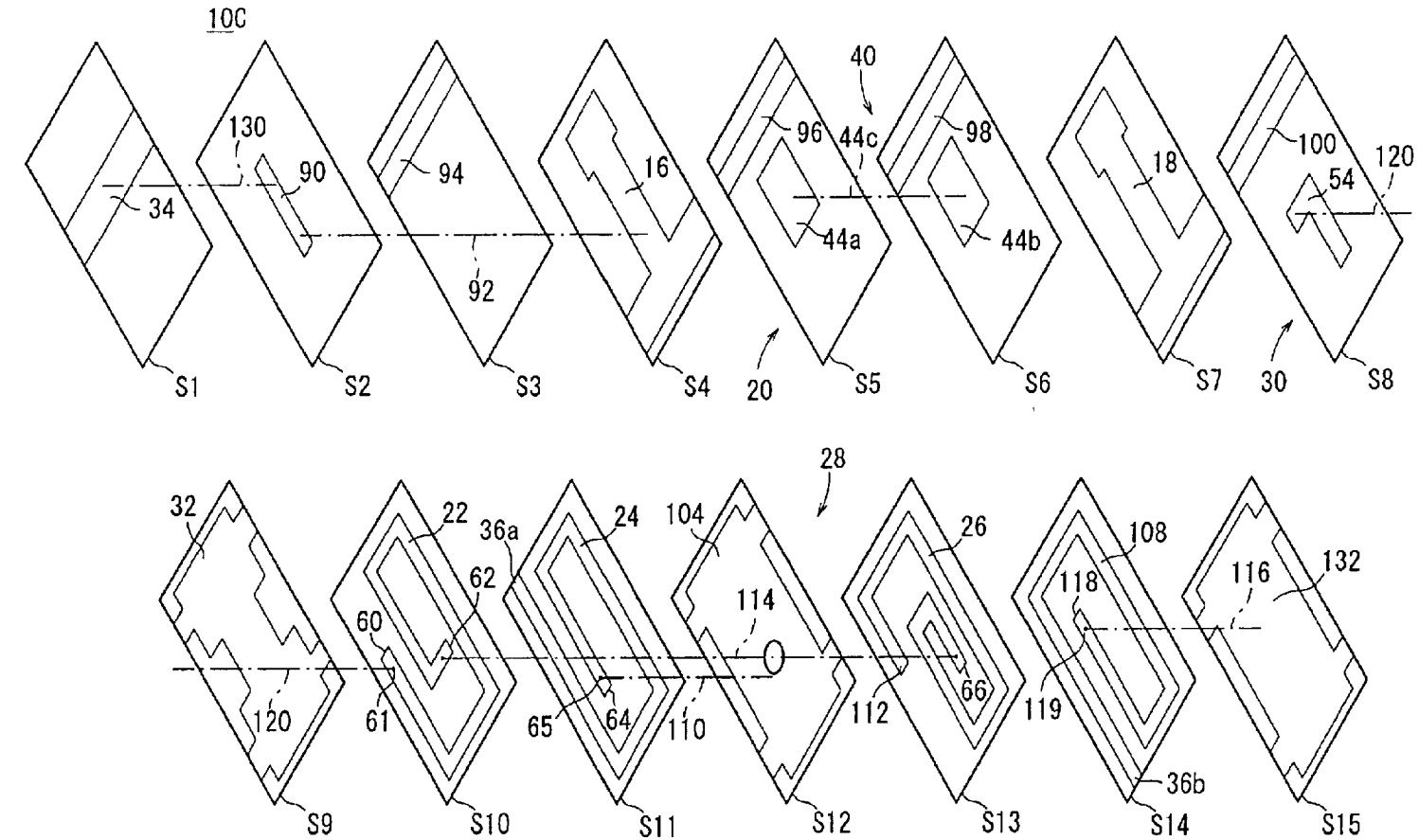
FIG. 23 shows an exploded perspective view illustrating the stacked dielectric filter according to the third embodiment.

As shown in FIG. 23, a filter section 20 is formed at a former half portion in the stacking direction of the dielectric layers S1 to S15 of the dielectric substrate 14, a converting section 28 is formed at a latter half portion in the stacking direction, and a connecting section 30 is formed at a central portion in the stacking direction.

As shown in FIG. 22, an unbalanced input terminal 34 is formed at a central portion of a second side surface 14*b* of the outer circumferential surface of the dielectric substrate 14. A first balanced output terminal 36*a* is formed on a fourth side surface 14*d*. A second balanced output terminal 36*b* is formed on a first side surface 14*a*. Further, there are areas for insulating the unbalanced input terminal 34 and the respective balanced output terminals 36*a*, 36*b* from the ground electrodes (including inner layer ground electrodes).

As shown in FIG. 23, the filter section 20 has an input side resonant electrode 16 (¼ wavelength input side resonator) and an output side resonant electrode 18 (¼ wavelength output side resonator). The input side resonant electrode 16 is formed on the first principal surface of the fourth dielectric layer S4. The output side resonant electrode 18 is formed on the first principal surface of the seventh dielectric layer S7. Open ends of the resonant electrodes 16, 18 are formed to be wider than intermediate portions. Respective short circuit end portions of the resonant electrodes 16, 18 are configured to be branched into two so that they are connected to the upper and lower ground electrodes 12*a*, 12*b* (see FIG. 22).

An input electrode 90 is formed on the first principal surface of the second dielectric layer S2. The input electrode 90 is electrically connected to the unbalanced input terminal 34 through a via-hole 130 which is formed for the first dielectric layer S1. The input electrode 90 is electrically connected to the input side resonant electrode 16 through a via-hole 92 which is formed in a region ranging over the second and third dielectric layers S2, S3. The input electrode 90 is an electrode for adjusting the impedance. In this embodiment, the adjustment is made to 50Ω.

An inner layer ground electrode 94 is formed on the first principal surface of the third dielectric layer S3. Both ends of the inner-layer ground electrode 94 are connected to the ground electrodes 12*a*, 12*b* respectively. The third dielectric layer S3 is interposed between the inner layer ground electrode 94 and the open end of the input side resonant electrode 16.

A first electrode 44*a* of a coupling-adjusting electrode 44 and an inner layer ground electrode 96 are formed on the first principal surface of the fifth dielectric layer S5. The fourth dielectric layer S4 is interposed between the first electrode 44*a* and the input side resonant electrode 16. Both ends of the inner layer ground electrode 96 are connected to the ground electrodes 12*a*, 12*b* respectively. The fourth dielectric layer S4 is interposed between the inner layer ground electrode 96 and the open end of the input side resonant electrode 16.

A second electrode 44*b* of the coupling-adjusting electrode 44 and an inner layer ground electrode 98 are formed on the first principal surface of the sixth dielectric layer S6. The sixth dielectric layer S6 is interposed between the second electrode 44*b* and the output side resonant electrode 18. Both ends of the inner layer ground electrode 98 are connected to the ground electrodes 12*a*, 12*b* respectively. The sixth dielectric layer S6 is interposed between the inner layer ground electrode 98 and the open end of the output side resonant electrode 18.

The coupling-adjusting electrode 44 is constructed by the first electrode 44*a*, the second electrode 44*b*, and a via-hole 44*c*. The via-hole 44*c* is formed for the fifth dielectric layer S5, and it electrically connects the first and second electrodes 44*a*, 44*b*.

An inner layer ground electrode 100 and an L-shaped connecting electrode 54 are formed on the first principal surface of the eighth dielectric layer S8. Both ends of the inner layer ground electrode 100 are connected to the ground electrodes 12*a*, 12*b* respectively. The seventh dielectric layer S7 is interposed between the inner layer ground electrode 100 and the open end of the output side resonant electrode 18. The connecting electrode 54 is formed at a position opposed to the central portion of the output side resonant electrode 18 on the first principal surface of the eighth dielectric layer S8. The seventh dielectric layer S7 is interposed between the connecting electrode 54 and the output side resonant electrode 18. The connecting electrode 54 has a first end which is connected to the converting section 28. The connecting electrode 54 also functions as an output capacitor electrode 50. The connecting section 30 is constructed by the connecting electrode 54.

An inner layer ground electrode 32, which is connected to the ground electrodes 12*a*, 12*b* respectively and which is provided in order to isolate the filter section 20 from the converting section 28, is formed on the first principal surface of the ninth dielectric layer S9.

Additionally, the converting section 28 has inner layer ground electrodes 104, 132 and first to fourth strip lines 22, 24, 26, 108. The inner layer ground electrode 104 is formed on the first principal surface of the twelfth dielectric layer S12, and the inner layer ground electrode 132 is formed on the first principal surface of the fifteenth dielectric layer S15. The first strip line 22 is formed on the first principal surface of the tenth dielectric layer S10, the second strip line 24 is formed on the first principal surface of the eleventh dielectric layer S11, the third strip line 26 is formed on the first principal surface of the thirteenth dielectric layer S13, and the fourth strip line 108 is formed on the first principal surface of the fourteenth dielectric layer S14.

The first strip line 22, which is formed on the first principal surface of the tenth dielectric layer S10, is configured to be converged in a spiral form from a first start end 60 formed at a position close to the lower surface of the dielectric substrate 14 to a terminal end 62 (approximately central portion of the tenth dielectric layer S10). A second end of the connecting electrode 54 described above is electrically connected through a via-hole 120 at the first start end 60 or at a position in the vicinity of the first start end 60 on the first strip line 22 (first connection position 61).

The second strip line 24 is configured to be patterned in a spiral form toward the first balanced output terminal 36*a* from a second start end 64 formed at an approximately central portion of the eleventh dielectric layer S11. The inner layer ground electrode 104 is electrically connected through a via-hole 110 at the second start end 64 or at a position in the vicinity of the second start end 64 on the second strip line 22 (second connection portion 65).

The third strip line 26 is configured to be patterned in a spiral form from a third start end 66 corresponding to the terminal end of the first strip line 22 described above toward a terminal end 112 (formed at a position close to the lower surface of the dielectric substrate 14). The first start end 62 and the third start end 66 are electrically connected to one another through a via-hole 114 formed in a region ranging over the tenth to twelfth dielectric layers S10 to S12. There is an area for insulating the via-hole 114 from the inner layer ground electrode 104, i.e., an area in which no electrode film is formed on the first principal surface of the twelfth dielectric layer S12.

The fourth strip line 108 is configured to be patterned in a spiral form from a fourth start end 118 formed at an approximately central portion of the fourteenth dielectric layer S14 toward the second balanced output terminal 36*b*. The fourth strip line 108 is electrically connected to the inner layer ground electrode 132 through a via-hole 116 at the fourth start end 118 or at a position in the vicinity of the fourth start end 118 (third connection position 119) on the fourth strip line 108.

In other words, the converting section 28 is the same as the converting section 28 of the stacked dielectric filter 10B according to the second embodiment described above. That is, one coupling line of the first and second strip lines 22, 24 is separated by the inner layer ground electrode 104 from the other coupling line of the third and fourth strip lines 26, 108.

Also in the third embodiment, in the same manner as in the first embodiment, the first to fifteenth dielectric layers S1 to S15 of different materials are used as the plurality of dielectric layers of the dielectric substrate 14. The dielectric layers S1 to S15 are stacked, sintered, and integrated into one unit.

It is preferable that the dielectric layers having high dielectric constants (for example, ∈=25) are used as the dielectric layers (first to eighth dielectric layers S1 to S8) of the portion for forming the capacitor in the filter section 20. The dielectric layers having low dielectric constants (for example, ∈=7) are used as the dielectric layers (ninth to fifteenth dielectric layers S9 to S15) for the converting section 28.

As for the filter 10C, in the same manner as in the filter 10A, it is possible to effectively realize the miniaturization, and it is possible to increase the degree of flexibility of designing of each of the components. Further, the filter section 20 is isolated from the converting section 28 by the inner layer ground electrode 32. Therefore, it is possible to effectively avoid any unnecessary coupling between the filter section 20 and the converting section 28.

In the converting section 28, the one coupling line of the first and second strip lines 22, 24 is separated by the inner layer ground electrode 104 from the other coupling line of the third and fourth strip lines 26, 108. Therefore, it is possible to suppress the interference between the coupling lines, and it is possible to obtain the good balance of the output characteristics of the converting section 28.

Further, in the filter 10C, the planes, on which the respective resonant electrodes 16, 18 of the input side resonator and the output side resonator are formed, are perpendicular to the planes on which the ground electrodes 12*a*, 12*b* are formed. Further, the plane, on which the unbalanced input terminal 34 of the filter section 20 is formed, is parallel to the planes on which the respective strip lines 22, 24, 26, 108 of the converting section 28 are formed. Therefore, the unbalanced input terminal 34 and the respective strip lines 22, 24, 26, 108 can be separated from each other. It is possible to eliminate any unnecessary interference between the unbalanced input terminal 34 and the respective strip lines 22, 24, 26, 108.

The dielectric constants of the dielectric layers of the portion for forming the capacitor in the filter section 20 are higher than the dielectric constants of the dielectric layers of the converting section 28. Therefore, it is possible to reduce the electrode area in the filter section 20. Further, it is possible to suppress the stray coupling in the converting section 28.

Also in the filter 10C, the output impedance of the converting section 28, the level balance, and the phase balance can be adjusted by appropriately changing the widths and the electrically effective lengths of the first to fourth strip lines 22, 24, 26, 108 and the dielectric constants of the ninth to fifteenth dielectric layers S9 to S15.

In the filter 10C, an apparent reactance circuit is equivalently connected to the output terminal of the converting section 28. No reactance circuit is connected to the output terminal of the converting section 28. However, the converting section 28 operates as if it is connected to a reactance circuit. The output impedance of the converting section 28 can be appropriately changed. Further, the input impedance of the converting section 28 can be adjusted to have an arbitrary value.

Next, a modified embodiment of the filter 10C will be explained with reference to FIGS. 24 and 25.

A filter 10C*a* is constructed in approximately the same manner as the filter 10C described above. However, the former is different from the latter in the following points.

Figure 24:
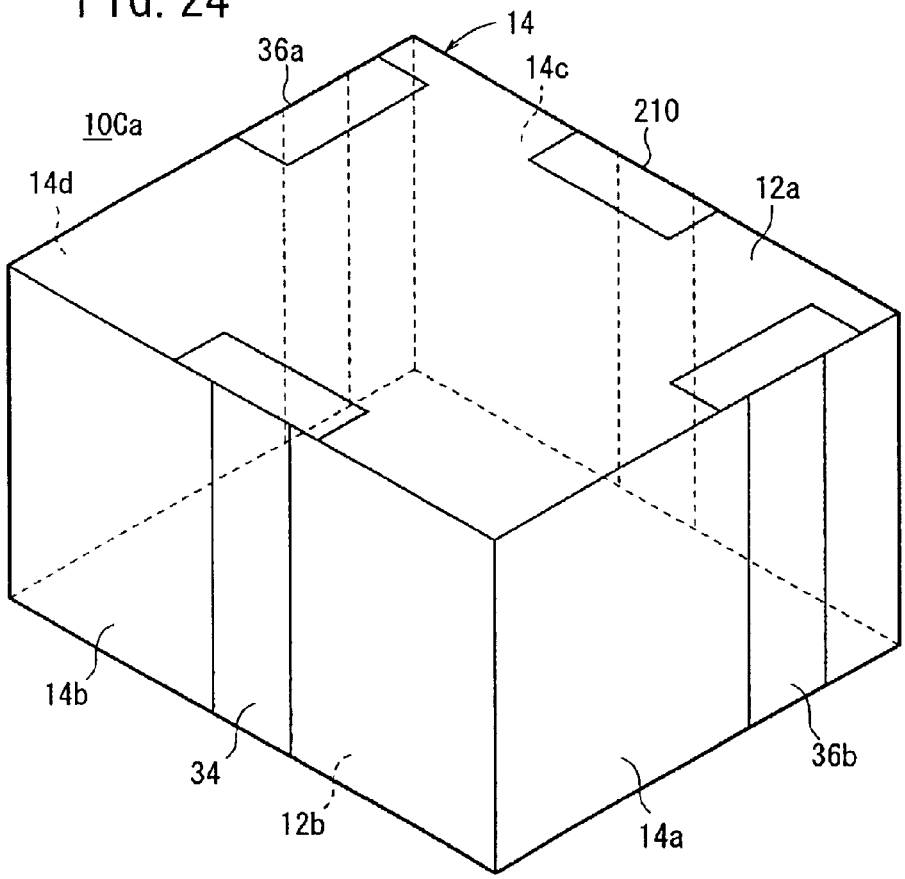
FIG. 24 shows a perspective view illustrating a modified embodiment of the stacked dielectric filter according to the third embodiment.

That is, as shown in FIG. 24, a DC electrode 210, which is connected to a DC power source, is formed between first and second balanced output terminals 36*a*, 36*b* on a third side surface 14*c* of a dielectric substrate 14.

Figure 25:
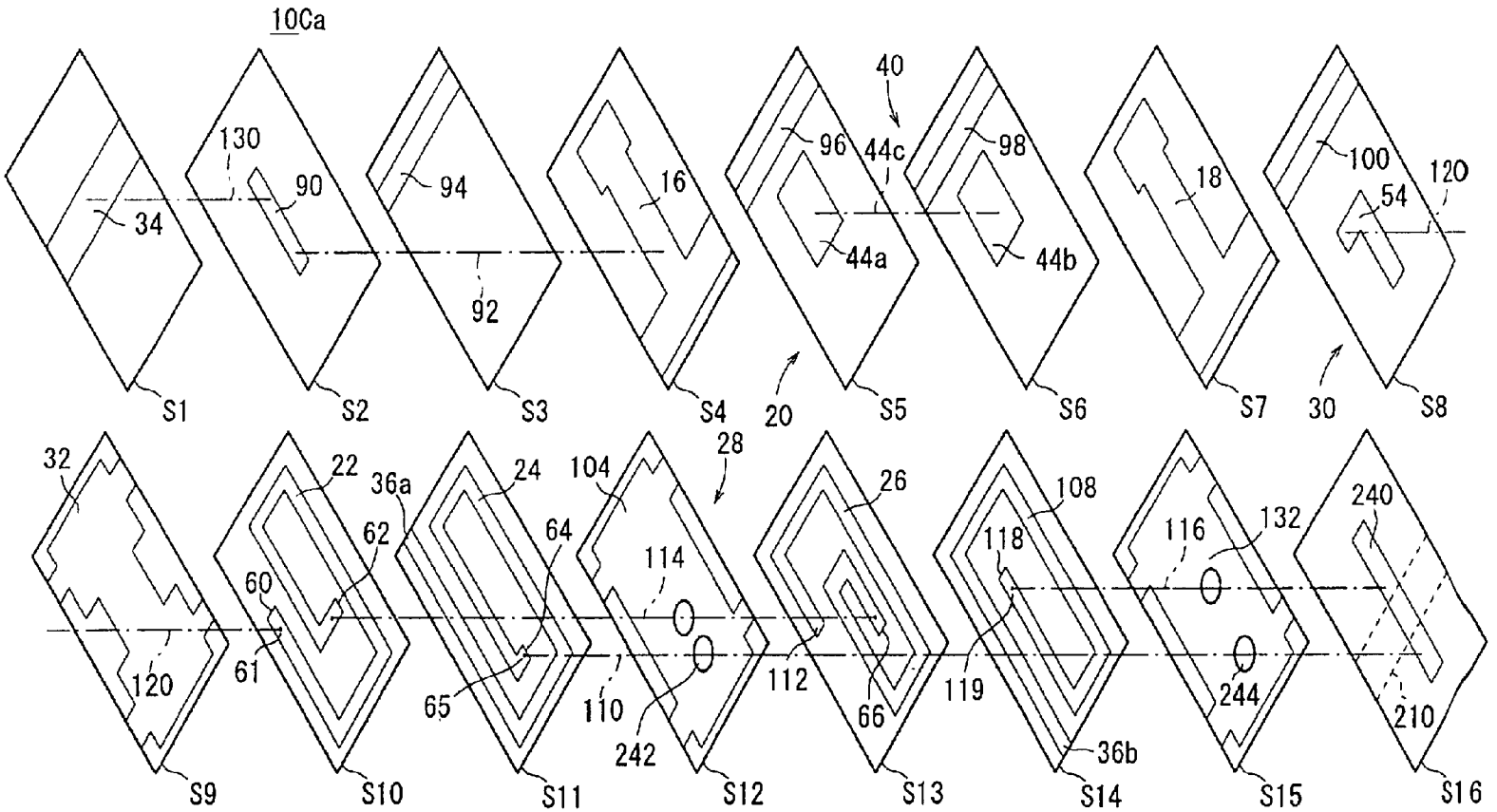
FIG. 25 shows an exploded perspective view illustrating the modified embodiment of the stacked dielectric filter according to the third embodiment.

Further, as shown in FIG. 25, an inner layer DC electrode 240 is formed on a first principal surface of a sixteenth dielectric layer S16. The inner layer DC electrode 240 is connected to the DC electrode 210. The second connection portion 65 of the second strip line 24 is connected through the via-hole 110 to the inner layer DC electrode 240. The third connection position 119 of the fourth strip line 108 is connected to the inner layer DC electrode 240 through the via-hole 116. In this arrangement, an area 242 for insulating the via-hole 110 from the inner layer ground electrode 104 formed on the first principal surface of the twelfth dielectric layer S12. Further, an area 244 for insulating the via-hole 116 from the inner layer ground electrode 132 is formed on the first principal surface of the fifteenth dielectric layer S15.

Also in the filter 10C*a*, when an IC 202 which requires a DC voltage is connected to the filter 10C*a*, it is unnecessary to connect any dedicated circuit for supplying the DC voltage to the IC 202. As a result, it is possible to realize the miniaturization of the circuit system including the stacked dielectric filter and the IC.

Next, a stacked dielectric filter 10D according to a fourth embodiment will be explained with reference to FIGS. 26 and 27.

The filter 10D is based on the balanced input system and the balanced output system unlike the filters 10A to 10C described above.

Figure 26:
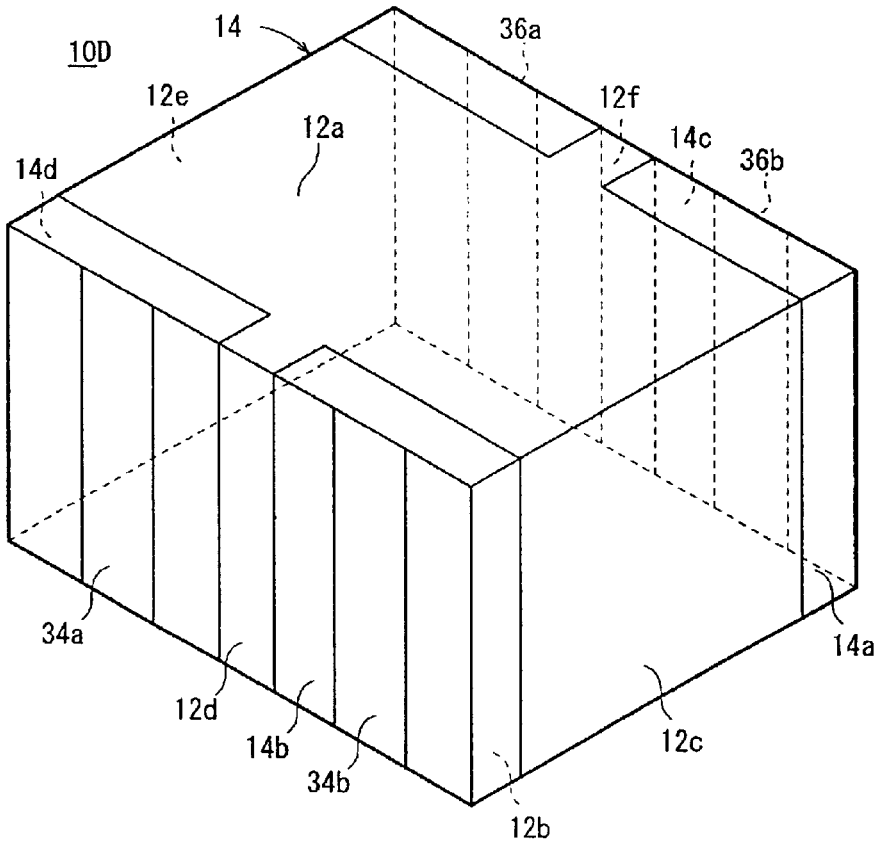
FIG. 26 shows a perspective view illustrating a stacked dielectric filter according to a fourth embodiment.

As shown in FIG. 26, the filter 10D has a dielectric substrate 14. The dielectric substrate 14 is constructed by stacking, sintering, and integrating a plurality of dielectric layers (S1 to S15, see FIG. 27) into one unit. Ground electrodes 12*a*, 12*b* are formed on both principal surfaces (first principal surface of the first dielectric layer S1 and first principal surface of the fifteenth dielectric layer S15) of the dielectric substrate 14 respectively.

Figure 27:
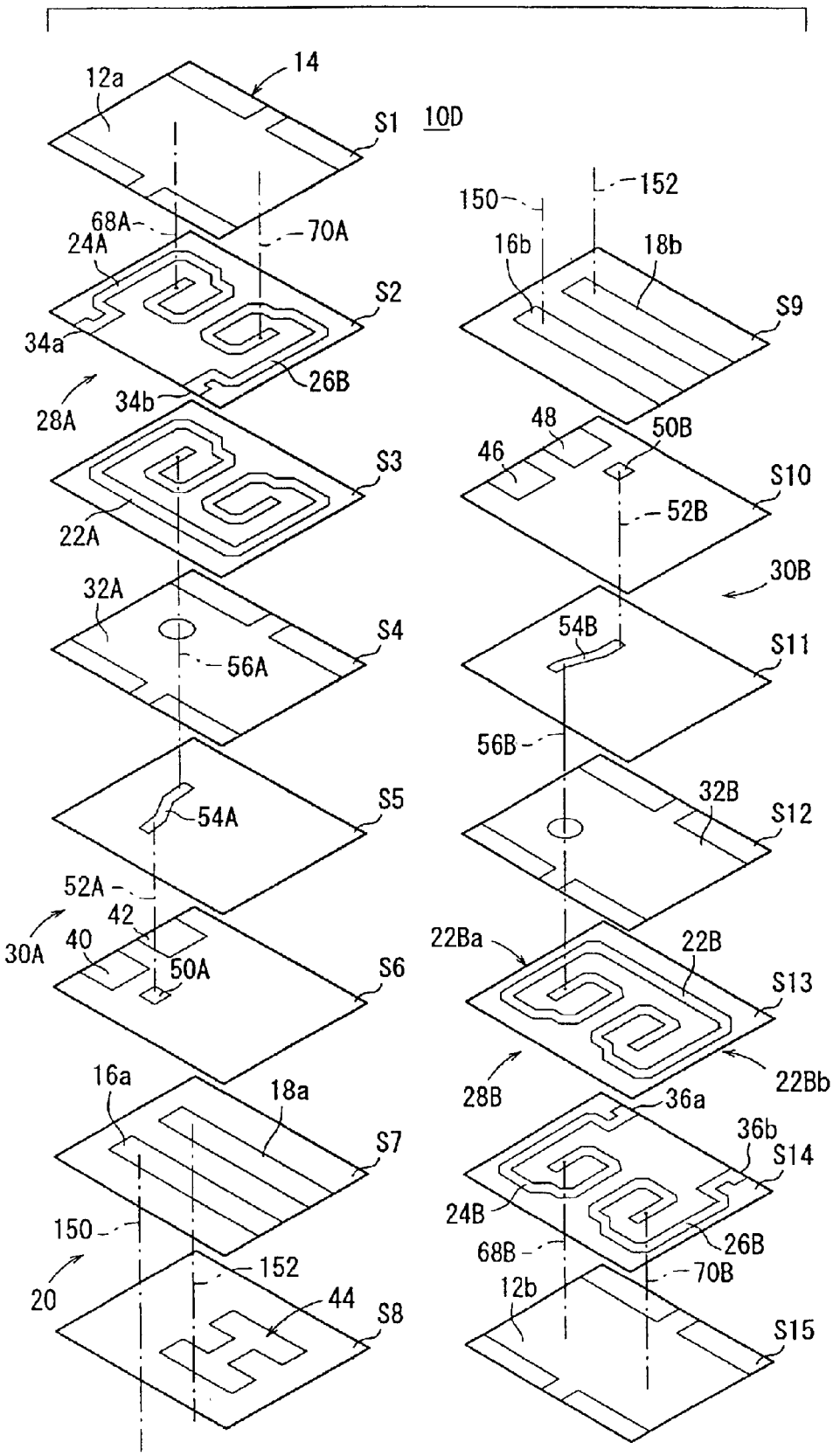
FIG. 27 shows an exploded perspective view illustrating the stacked dielectric filter according to the fourth embodiment.

As shown in FIG. 27, an input side converting section 28A is formed at an upper portion in the stacking direction of the dielectric layers S1 to S15 of the dielectric substrate 14, an output side converting section 28B is formed at a lower portion in the stacking direction, and a filter section 20 is formed at a central portion in the stacking direction. An input side connecting section 30A is formed between the input side converting section 28A and the filter section 20. An output side connecting section 30B is formed between the output side converting section 28B and the filter section 20. In other words, the filter 10D is constructed such that the input side converting section 28A and the output side connecting section 30A are added to the filter 10A.

Therefore, the constitutive members, which correspond to those of the filter 10A, are designated by the same reference numerals, duplicate explanation of which will be omitted. As for the respective constitutive members of the input side converting section 28A, the output side converting section 28B, the input side connecting section 30A, and the output side connecting section 30B, reference numerals for those on the input side are affixed with A, and reference numerals for those on the output side are affixed with B. Duplicate explanation will be omitted for the converting sections 28A, 28B and the connecting sections 30A, 30B.

In the filter 10D, the input side converting section 28A is arranged over the filter section 20. For this reason, a coupling-adjusting electrode 44 is formed on the first principal surface of the eighth dielectric layer S8. A first input side resonant electrode 16*a* and a first output side resonant electrode 18*a* are formed on the first principal surface of the seventh dielectric layer S7. A second input side resonant electrode 16*b* and a second output side resonant electrode

18*b* are formed on the first principal surface of the ninth dielectric layer S9.

A via-hole 150 for electrically connecting the respective open ends is formed between the first and second input side resonant electrodes 16*a*, 16*b*. A via-hole 152 for electrically connecting the respective open ends is formed between the first and second output side resonant electrodes 18*a*, 18*b*.

As shown in FIG. 26, a ground electrode 12*d* is formed at a central portion of the second side surface 14*b* of the outer circumferential surface of the dielectric substrate 14. First and second balanced input terminals 34*a*, 34*b* are formed on both sides of the ground electrode 12*d*. A ground electrode 12*f* is formed at a central portion of the third side surface 14*c*. First and second balanced output terminals 36*a*, 36*b* are formed on both sides of the ground electrode 12*f*. Ground electrodes 12*c*, 12*e* are formed on the first and fourth side surfaces 14*a*, 14*d* respectively. There are areas for insulating the balanced input terminals 34*a*, 34*b* and the balanced output terminals 36*a*, 36*b* from the ground electrodes (including inner layer ground electrodes) respectively.

When the filter 10D is employed, it is possible to easily manufacture a stacked dielectric filter of the balanced input/output system using the ¼ wavelength resonator. Further, it is also possible to realize the miniaturization of the stacked dielectric filter.

Also in the filter 10D, the output impedance of the output side converting section 28B, the level balance, and the phase balance can be adjusted by appropriately changing the respective widths and the electrically effective lengths of the first portion 22B*a* and the second portion 22B*b* of the first strip line 22B, the second strip line 24B, and the third strip line 26B of the output side converting section 28B, and the dielectric constants of the twelfth to fourteenth dielectric layers S12 to S14.

Also in the filter 10D, an apparent reactance circuit may be equivalently connected to the output terminal of the output side converting section 28B. It is possible to appropriately change the output impedance of the output side converting section 28B. Further, the input impedance of the output side converting section 28B can be adjusted to have an arbitrary value.

Figure 28:
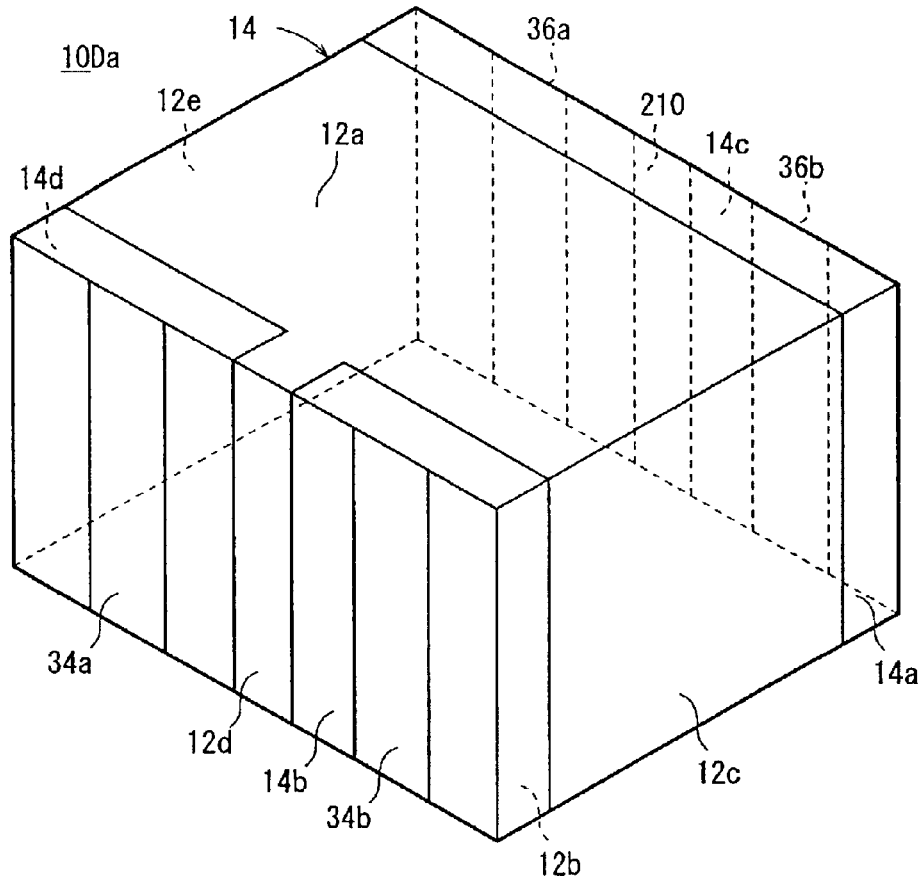
FIG. 28 shows a perspective view illustrating a modified embodiment of the stacked dielectric filter according to the fourth embodiment.

Next, a modified embodiment of the filter 10D will be explained with reference to FIGS. 28 and 29.

A filter 10D*a* is constructed in approximately the same manner as the filter 10D described above. However, the former is different from the latter in the following points. That is, as shown in FIG. 28, a DC electrode 210, which is connected to a DC power source, is formed between first and second balanced output terminals 36*a*, 36*b* on a third side surface 14*c* of a dielectric substrate 14.

Figure 29:
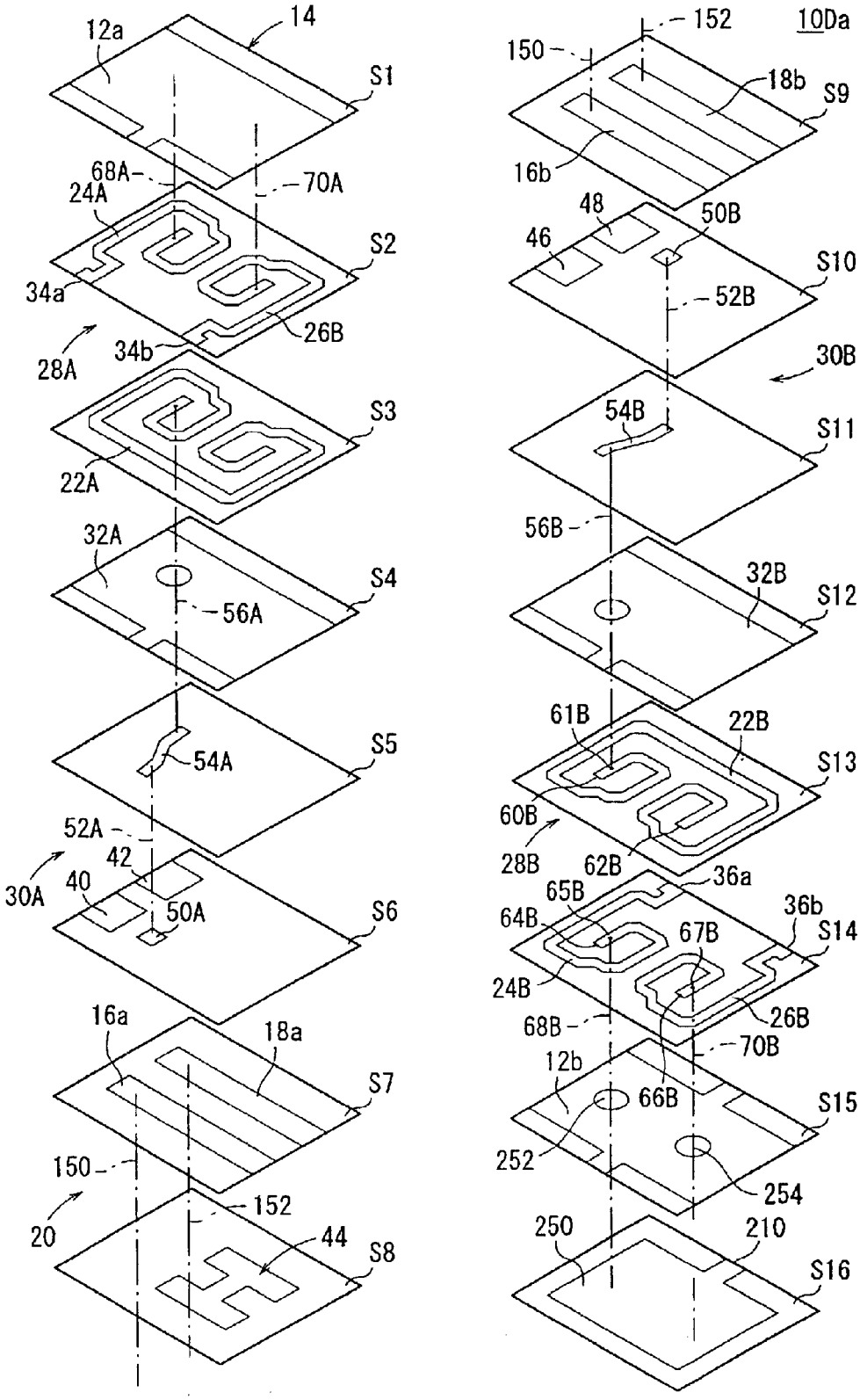
FIG. 29 shows an exploded perspective view illustrating the modified embodiment of the stacked dielectric filter according to the fourth embodiment.

Further, as shown in FIG. 29, an inner layer DC electrode 250, which is connected to the DC electrode 210, is formed on a first principal surface of a sixteenth dielectric layer S16. The second connection portion 65B of the second strip line 24B is connected to the inner layer DC electrode 250 through the via-hole 68B. The third connection portion 67B of the third strip line 26B is connected to the inner layer DC electrode 250 through the via-hole 70B. In this arrangement, areas 252 and 254 for insulating the via-holes 68B, 70B from the ground electrode 12*b* are formed on the first principal surface of the tenth dielectric layer S10.

As for the filter 10D*a*, when an IC 202 which requires the DC voltage is connected to the filter 10D*a*, it is unnecessary to connect any dedicated circuit for supplying the DC voltage to the IC 202. As a result, it is possible to realize the miniaturization of the circuit system including the stacked dielectric filter 10D*a* and the IC 202.

It is a matter of course that the stacked dielectric filter according to the present invention is not limited to the embodiments described above. Various modifications can be made without deviating from the scope of the present invention.

What is claimed is:

1. A stacked dielectric filter comprising a filter section having a plurality of resonators for filtering an unbalanced signal, and at least one unbalanced-balanced converting section having strip lines, said filter section and said unbalanced-balanced converting section being in a dielectric substrate including a plurality of stacked dielectric layers, wherein said unbalanced-balanced converting section is connected via a connecting section to an input side and/or an output side of said filter section.

2. The stacked dielectric filter according to claim 1, wherein said dielectric substrate includes said plurality of stacked dielectric layers made of different materials.

3. The stacked dielectric filter according to claim 2, wherein a dielectric constant of said dielectric layer corresponding to said filter section is higher than a dielectric constant of said dielectric layer corresponding to said unbalanced-balanced converting section.

4. The stacked dielectric filter according to claim 1, wherein said filter section is formed at an upper portion or a lower portion in a stacking direction of said plurality of dielectric layers of said dielectric substrate, and said unbalanced-balanced converting section is formed at a portion other than said upper portion and said lower portion.

5. The stacked dielectric filter according to claim 4, wherein ground electrodes are formed on both principal surfaces of said dielectric substrate; and planes on which resonant electrodes of said plurality of resonators are formed and planes on which said ground electrodes are formed are parallel to one another.

6. The stacked dielectric filter according to claim 5, wherein planes on which input/output terminals of said filter section are formed and planes on which said strip lines of said unbalanced-balanced converting section are formed are perpendicular to one another.

7. The stacked dielectric filter according to claim 4, wherein ground electrodes are formed on both principal surfaces of said dielectric substrate; and planes on which resonant electrodes of said plurality of resonators are formed and planes on which said ground electrodes are formed are perpendicular to one another.

8. The stacked dielectric filter according to claim 4, wherein planes on which input/output terminals of said filter section are formed and planes on which said strip lines of said unbalanced-balanced converting section are formed are parallel to one another.

9. The stacked dielectric filter according to claim 1, wherein said filter section is formed at a left portion or a right portion in a stacking direction of said plurality of dielectric layers of said dielectric substrate, and said unbalanced-balanced converting section is formed at a portion other than said left portion and said right portion.

10. The stacked dielectric filter according to claim 9, wherein ground electrodes are formed on both principal surfaces of said dielectric substrate; and planes on which resonant electrodes of said plurality of resonators are formed and planes on which said ground electrodes are formed are parallel to one another.

11. The stacked dielectric filter according to claim 10, wherein planes on which input/output terminals of said filter section are formed and planes on which said strip lines of said unbalanced-balanced converting section are formed are perpendicular to one another.

12. The stacked dielectric filter according to claim 1, further comprising:

an inner layer ground electrode which is provided in said dielectric substrate and which is connected to a ground electrode, wherein said connecting section is formed separately from said unbalanced-balanced converting section with said inner layer ground electrode interposed therebetween, and said connecting section is electrically connected to an unbalanced input/output section of said unbalanced-balanced converting section.

13. The stacked dielectric filter according to claim 12, wherein said inner layer ground electrode isolates said filter section from said unbalanced-balanced converting section.

14. The stacked dielectric filter according to claim 1, wherein said connecting section has a connecting electrode which is connected to said filter section via a capacitor.

15. The stacked dielectric filter according to claim 1, wherein said unbalanced-balanced converting section comprises:

a first strip line which is formed on a first principal surface of said dielectric layer and which has a first end of an unbalanced input/output section;

a second strip line which is formed on a first principal surface of said dielectric layer, which has a first end connected to one balanced input/output terminal, and which is connected to a ground electrode at an arbitrary position on said second strip line; and a third strip line which is formed on said first principal surface of said dielectric layer, which has a first end connected to the other balanced input/output terminal, and which is connected to said ground electrode at an arbitrary position on said third strip line.

16. The stacked dielectric filter according to claim 15, further comprising:

an inner layer ground electrode which is provided in said dielectric substrate and which is connected to said ground electrode, wherein second ends of said second and third strip lines are connected to said inner layer ground electrode through via-holes.

17. The stacked dielectric filter according to claim 15, wherein said second and third strip lines are arranged in linear symmetry about a line by which a line segment for connecting said plurality of balanced input/output terminals is equally divided into two, and respective physical lengths of said second and third strip lines are substantially identical with each other.

18. The stacked dielectric filter according to claim 15, wherein a width of a first portion of said first strip line corresponding to said second strip line, a length of said first portion, a width of a second portion of said first strip line corresponding to said third strip line, a length of said second portion, a width of said second strip line, an electrically effective length of said second strip line, a width of said third strip line, an electrically effective length of said third strip line, and a dielectric coolant of said dielectric layer disposed between said first strip line and said second and third strip lines are determined corresponding to an output impedance, level balance, and phase balance of said unbalanced-balanced converting section.

19. The stacked dielectric filter according to claim 18, wherein an input impedance of said unbalanced-balanced converting section has a value other than 50Ω.

20. The stacked dielectric filter according to claim 1, further comprising:

a DC electrode which is formed on a surface of said dielectric substrate and which is connected to a DC power source, wherein said unbalanced-balanced converting section comprises:

a first strip line which is formed on a first principal surface of said dielectric layer and which has a first end of an unbalanced input/output section;

a second strip line which is formed on a first principal surface of said dielectric layer, which has a first end connected to one balanced input/output terminal, and which is connected to said DC electrode at an arbitrary position on said second strip line; and a third strip line which is formed on said first principal surface of said dielectric layer, which has a first end connected to the other balanced input/output terminal, and which is connected to said DC electrode at an arbitrary position on said third strip line.

21. The stacked dielectric filter according to claim 20, further comprising:

an inner layer ground electrode which is provided in said dielectric substrate and which is connected to a ground electrode, wherein said second and third strip lines are connected to said DC electrode at respective arbitrary positions on said second and third strip lines through via-holes respectively beyond said inner layer ground electrode.

22. The stacked dielectric filter according to claim 21, further comprising:

an inner layer DC electrode which is provided in said dielectric substrate and which is connected to said DC electrode, wherein said second and third strip lines are connected to said inner layer DC electrode at respective arbitrary positions on said second and third strip fines through said via-holes respectively.

23. The stacked dielectric filter according to claim 20, wherein said second and third strip lines are arranged in linear symmetry about a center of a line by which a line segment for connecting said plurality of balanced input/output terminals is equally divided into two, and respective physical lengths of said second and third strip lines are substantially identical with each other.

24. The stacked dielectric filter according to claim 20, wherein a width of a first portion of said first strip line corresponding to said second strip line, a length of said first portion, a width of a second portion of said first strip line corresponding to said third strip line, a length of said second portion, a width of said second strip line, an electrically effective length of said second strip line, a width of said third strip line, an electrically effective length of said third strip line, and a dielectric constant of said dielectric layer disposed between said first strip line and said second and third strip lines are determined corresponding to an output impedance, level balance, and phase balance of said unbalanced-balanced converting section.

25. The stacked dielectric filter according to claim 24, wherein an input impedance of said unbalanced-balanced converting section has a value other than 50Ω.

26. The stacked dielectric filter according to claim 1, wherein said unbalanced-balanced converting section comprises:

a first strip line which is formed on a first principal surface of said dielectric layer and which has a first end of an unbalanced input/output section;

a second strip line which is formed on a first principal surface of said dielectric layer, which has a first end connected to one balanced input/output terminal, and which is connected to a ground electrode at an arbitrary position on said second strip line;

a third strip line which is formed on a first principal surface of said dielectric layer and which has a first end connected to a second end of said first strip line; and a fourth strip line which is formed on a first principal surface of said dielectric layer, which has a first end connected to the other balanced input/output terminal, and which is connected to said ground electrode at an arbitrary position on said fourth strip line.

27. The stacked dielectric filter according to claim 26, further comprising:

an inner layer ground electrode connected to said ground electrode, said inner layer ground electrode being formed between said dielectric layer on which said second strip line is formed and said dielectric layer on which said third strip line is formed, wherein said second strip line is connected to said inner layer ground electrode at an arbitrary position on said second strip line.

28. The stacked dielectric filter according to claim 26, wherein a width of said first strip line, a length of said first strip line, a width of said second strip line, an electrically effective length of said second strip line, a width of said third strip line, a length of said third strip line, a width of said fourth strip line, an electrically effective length of said fourth strip line, and a dielectric constant or dielectric constants of one or more of said dielectric layers disposed in a region ranging from said first strip line to said fourth strip line are determined corresponding to an output impedance, level balance, and phase balance of said unbalanced-balanced converting section.

29. The stacked dielectric filter according to claim 28, wherein an input impedance of said unbalanced-balanced converting section has a value other than 50Ω.

30. The stacked dielectric filter according to claim 1, further comprising:

a DC electrode which is formed on a surface of said dielectric substrate and which is connected to a DC power source, wherein said unbalanced-balanced converting section comprises:

a first strip line which is formed on a first principal surface of said dielectric layer and which has a first end of an unbalanced input/output section;

a second strip line which is formed on a first principal surface of said dielectric layer, which has a first end connected to one balanced input/output terminal, and which is connected to said DC electrode at an arbitrary position on said second strip line;

a third strip line which is formed on a first principal surface of said dielectric layer and which has a first end connected to a second end of said first strip line; and a fourth strip line which is formed on a first principal surface of said dielectric layer, which has a first end connected to the other balanced input/output terminal, and which is connected to said DC electrode at an arbitrary position on said fourth strip line.

31. The stacked dielectric filter according to claim 30, further comprising:

an inner layer ground electrode which is provided in said dielectric substrate and which is connected to a ground electrode, wherein said second and fourth strip lines are connected to said DC electrode at respective arbitrary positions on said second and fourth strip lines through via-holes respectively beyond said inner layer ground electrode.

32. The stacked dielectric filter according to claim 31, further comprising:

an inner layer DC electrode which is provided in said dielectric substrate and which is connected to said DC electrode, wherein said second and fourth strip lines are connected to said inner layer DC electrode at respective arbitrary positions on said second and fourth strip lines through said via-holes respectively.

33. The stacked dielectric filter according to claim 30, wherein a width of said first strip line, a length of said first strip line, a width of said second strip line, an electrically effective length of said second strip line, a width of said third strip line, a length of said third strip line, a width of said fourth strip line, an electrically effective length of said fourth strip line, and a dielectric constant or dielectric constants of one or more of said dielectric layers disposed in a region ranging from said first strip line to said fourth strip line are determined corresponding to an output impedance, level balance, and phase balance of said unbalanced-balanced converting section.

34. The stacked dielectric filter according to claim 33, wherein an input impedance of said unbalanced-balanced converting section has a value other than 50Ω.

35. The stacked dielectric filter according to claim 1, wherein a coupling-adjusting electrode for adjusting a coupling degree for said plurality of resonators is formed at a position separated from said connecting section with said resonators interposed therebetween.

36. The stacked dielectric filter according to claim 35, wherein said coupling-adjusting electrode is formed on a first principal surface of one dielectric layer of one or more of said dielectric layers arranged between a plurality of resonant electrodes when said resonators include said plurality of resonant electrodes arranged in a stacking direction.

37. The stacked dielectric filter according to claim 1, wherein said plurality of resonators of said filter section have different resonance frequencies respectively; and an apparent reactance element is equivalently connected to an output side of said unbalanced-balanced converting section.

38. The stacked dielectric filter according to claim 1, comprising two unbalanced-balanced converting sections.

39. The stacked dielectric filter according to claim 38, wherein one of said unbalanced-balanced converting sections is arranged prior to the input of the filter section and the other one of said unbalanced-balanced converting sections is arranged after the filter section.

* * * * *

UNITED STATES PATENT AND TRADEMARK OFFICE

CERTIFICATE OF CORRECTION

PATENT NO. : 6,828,881 B2
DATED : December 7, 2004
INVENTOR(S) : Yasuhiko Mizutani et al.

It is certified that error appears in the above-identified patent and that said Letters Patent is hereby corrected as shown below:

Column 18,
Line 66, change ";" to -- , --

Column 27,
Line 62, change "coolant" to -- constant --

Column 28,
Line 39, change "fines" to -- lines --

Signed and Sealed this

First Day of March, 2005

JON W. DUDAS
*Director of the United States Patent and Trademark Office*